US008521065B2

(12) United States Patent
Kikuchi et al.

(10) Patent No.: US 8,521,065 B2
(45) Date of Patent: Aug. 27, 2013

(54) FUSER FOR IMAGE FORMING APPARATUS

(75) Inventors: Kazuhiko Kikuchi, Kanagawa (JP); Shuji Yokoyama, Shizuoka (JP); Hiroshi Nakayama, Shizuoka (JP); Hiroaki Yamauchi, Shizuoka (JP); Satoshi Kinouchi, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 139 days.

(21) Appl. No.: 12/817,700

(22) Filed: Jun. 17, 2010

(65) Prior Publication Data

US 2010/0322681 A1 Dec. 23, 2010

Related U.S. Application Data

(60) Provisional application No. 61/218,847, filed on Jun. 19, 2009, provisional application No. 61/218,848, filed on Jun. 19, 2009, provisional application No. 61/218,855, filed on Jun. 19, 2009, provisional application No. 61/218,857, filed on Jun. 19, 2009, provisional application No. 61/226,616, filed on Jul. 17, 2009.

(51) Int. Cl.
*G03G 15/16* (2006.01)

(52) U.S. Cl.
USPC ..... 399/122; 399/323; 399/331; 219/216

(58) Field of Classification Search
USPC ..... 399/38, 67, 122, 320, 322, 323, 328–331, 399/335, 338; 219/216, 244, 619
See application file for complete search history.

(56) References Cited

U.S. PATENT DOCUMENTS

| | | | | |
|---|---|---|---|---|
| 5,315,359 | A * | 5/1994 | Nishikawa | 399/323 |
| 5,471,280 | A * | 11/1995 | Taguchi | 399/330 |
| 5,563,695 | A * | 10/1996 | Sakurai et al. | 399/327 |
| 2001/0036377 | A1 | 11/2001 | Tsujihara | |
| 2002/0037186 | A1 * | 3/2002 | Tanaka | 399/322 |
| 2005/0008413 | A1 * | 1/2005 | Takagi et al. | 399/330 |
| 2006/0210330 | A1 * | 9/2006 | Sone et al. | 399/328 |
| 2008/0063443 | A1 | 3/2008 | Yoshinaga et al. | |
| 2008/0175633 | A1 | 7/2008 | Shinshi | |
| 2008/0186986 | A1 | 8/2008 | Rigault et al. | |
| 2008/0260415 | A1 * | 10/2008 | Sone et al. | 399/88 |
| 2010/0034567 | A1 | 2/2010 | Sone et al. | |
| 2010/0322654 | A1 * | 12/2010 | Kikuchi et al. | 399/67 |
| 2010/0322655 | A1 * | 12/2010 | Kikuchi et al. | 399/67 |
| 2010/0322684 | A1 * | 12/2010 | Kikuchi et al. | 399/331 |

FOREIGN PATENT DOCUMENTS

| | | |
|---|---|---|
| JP | 07-064422 | 3/1995 |
| JP | 07-160133 | 6/1995 |
| JP | 09-274406 | 10/1997 |
| JP | 2000-089596 | 3/2000 |

(Continued)

*Primary Examiner* — Walter L Lindsay, Jr.
*Assistant Examiner* — Benjamin Schmitt
(74) *Attorney, Agent, or Firm* — Patterson & Sheridan, L.L.P.

(57) ABSTRACT

A fuser includes: a rotational member configured to rotate; a press member configured to press the rotational member; an induction-current generator configured to generate induction current in the rotational member; and a separator configured to separate a leading end of a recording medium that passes through a nip from the rotational member, when a distal end is in a separating position, and move to an open position.

4 Claims, 14 Drawing Sheets

(56) References Cited

FOREIGN PATENT DOCUMENTS

| | | |
|---|---|---|
| JP | 2002-072750 | 3/2002 |
| JP | 2002-287564 | 10/2002 |
| JP | 2003-005574 | 1/2003 |
| JP | 2003-162177 | 6/2003 |
| JP | 2004-302349 | 10/2004 |
| JP | 2005-099577 | 4/2005 |
| JP | 2006-227486 | 8/2006 |
| JP | 2007-086538 | 4/2007 |
| JP | 2008-009002 | 1/2008 |
| JP | 2008-015235 | 1/2008 |
| JP | 2008-102279 | 5/2008 |
| JP | 2008-203558 | 9/2008 |

* cited by examiner

FIG. 14
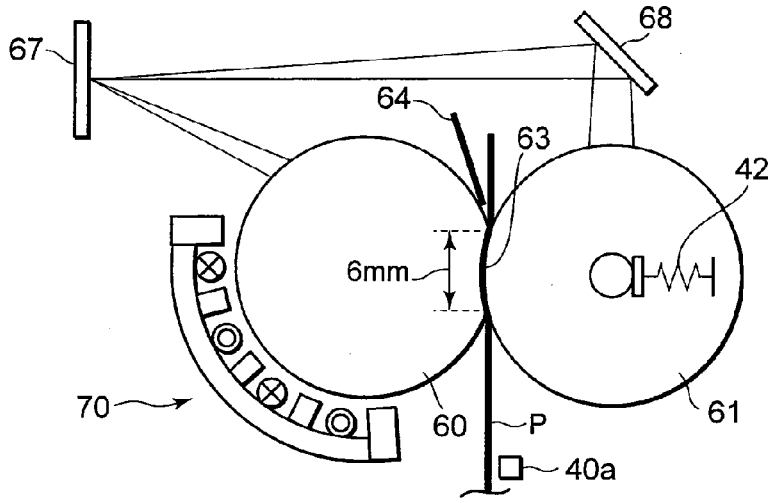
FIG. 15
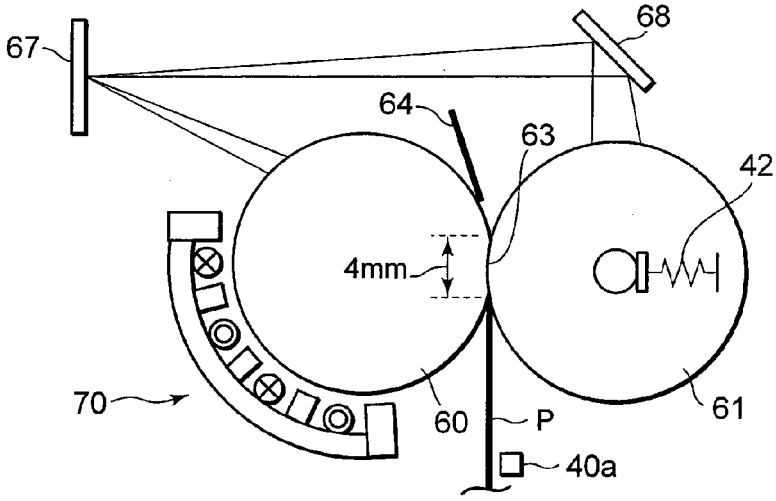
FIG. 16
| NIP WIDTH (mm) | | | | | | | | |
|---|---|---|---|---|---|---|---|---|
| 3 | 3.5 | 4 | 4.5 | 5 | 5.5 | 6 | 6.5 | 7 |
| A | A | A | A | A | B | B | C | C |

| | | PRESS ROLLER TEMPERATURE (°C) | | | | | | |
|---|---|---|---|---|---|---|---|---|
| | | 100 | 110 | 120 | 130 | 140 | 150 | 160 |
| HEAT ROLLER TEMPERATURE (°C) | 110 | A | A | A | A | B | B | B |
| | 120 | A | A | A | A | B | B | B |
| | 130 | A | A | A | A | B | B | B |
| | 140 | A | A | A | A | B | C | C |
| | 150 | A | B | B | B | B | C | C |
| | 160 | A | B | B | B | B | C | C |
| | 170 | A | B | B | B | B | C | C |

A : LEADING END MARGIN 2mm OK,
B : LEADING END MARGIN 3mm OK,
C : LEADING END MARGIN 3mm NG
( HALFTONE DOT MESHING INDICATES FIXING PERFORMANCE NG AREA DUE TO OFFSET )

FIG. 24
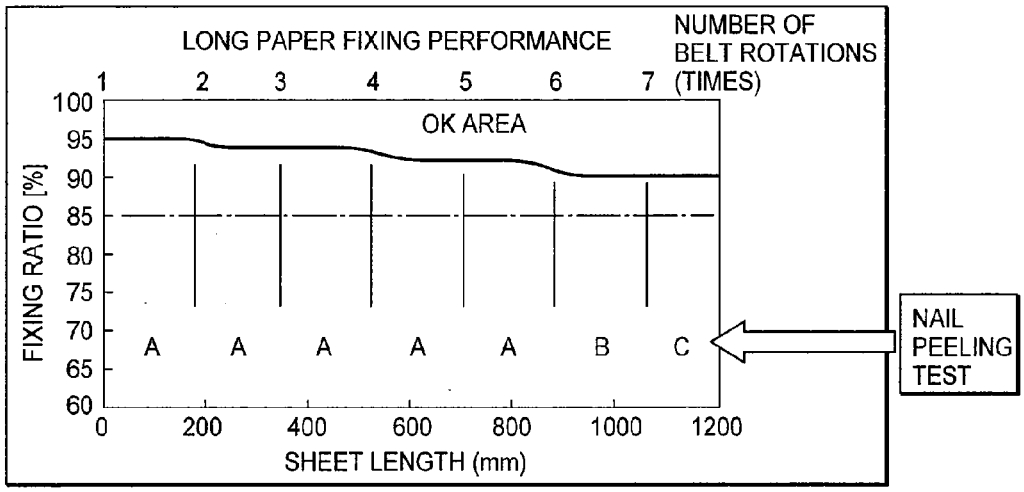
FIG. 25
| POWER SETTING | | BEFORE POWER SWITCHING | | AFTER POWER SWITCHING | |
|---|---|---|---|---|---|
| H | | 1100 | | 1200 | |
| LAMP | A | ALTERNATE | 300 | OFF | – |
| | B | ALTERNATE | | OFF | – |
| | C | OFF | – | TURN ON | 200 |
| TOTAL POWER | | 1400 | | 1400 | |
FIG. 26
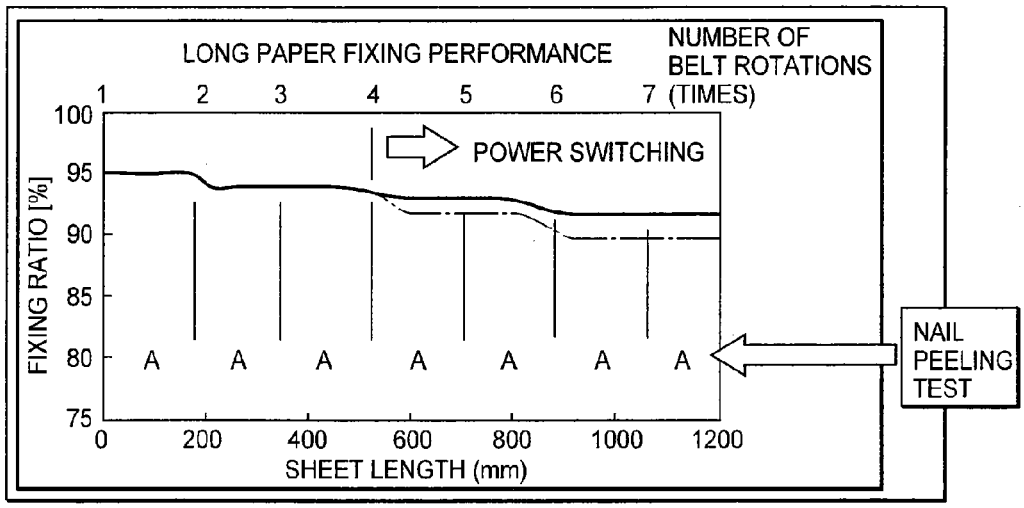

FUSER FOR IMAGE FORMING APPARATUS

CROSS-REFERENCE TO RELATED APPLICATION

This application is based upon and claims the benefit of priority from Provisional U.S. Applications 61/218,847 filed on Jun. 19, 2009, 61/218,848 filed on Jun. 19, 2009, 61/218,855 filed on Jun. 19, 2009, 61/218,857 filed on Jun. 19, 2009, and 61/226,616 filed on Jul. 17, 2009, the entire contents of which are incorporated herein by reference.

FIELD

Embodiments described herein relate generally to a fuser used in an image forming apparatus and configured to realize saving of energy.

BACKGROUND

As a fuser used in image forming apparatuses such as a copying machine and a printer, there is a fuser configured to insert a sheet through a nip formed between a pair of rollers including a heating roller and a pressing roller or between a heating belt and the pressing roller and heat, press, and fix a toner image on the sheet. As the fuser configured to perform heating, pressing, and fixing, in recent years, there is a device configured to feed induction current to a metal conductive layer on the surface of the heating roller or the heating belt to generate heat in order to realize saving of energy.

However, in the fuser configured to generate heat in the metal conductive layer with the induction current, when a heat capacity of the metal conductive layer is small, there is a marked temperature difference in surface temperature of the heating roller or the heating belt between an area where a sheet comes into contact with the heating roller or the heating belt and an area where the sheet does not come into contact with the heating roller or the heating belt. When there is marked temperature difference in the surface temperature of the heating roller or the heating belt, it is likely that stable fixing performance is not obtained and gloss unevenness occurs in a fixed image.

Therefore, there is a demand for development of a fuser that can stably maintain fixing performance, realize saving of energy, improve productivity of an image forming apparatus, and obtain a high-quality fixed image without gloss unevenness even when a heating roller or a heating belt has a small heat capacity.

DESCRIPTION OF THE DRAWINGS

FIG. 14 is a schematic explanatory diagram of nip width during normal fixing in a fifth embodiment;

FIG. 15 is a schematic explanatory diagram of nip width during passage of a sheet leading end in the fifth embodiment;

FIG. 16 is a graph of separating performance for the sheet leading end with respect to the nip width in the fifth embodiment;

FIG. 24 is a graph for explaining an example of fixing performance for a long sheet by the belt (B) in the eighth embodiment;

FIG. 25 is a table of an example of power switching during long sheet fixing in the eighth embodiment; and FIG. 26 is a graph for explaining an example of fixing performance on the long sheet by a fixing belt in the eighth embodiment.

DETAILED DESCRIPTION

According to an embodiment, a fuser includes: a rotational member configured to rotate; a press member configured to press the rotational member; an induction-current generator configured to generate induction current in the rotational member; and a separator configured to separate a leading end of a recording medium that passes through a nip from the rotational member, when a distal end is in a separating position, and move to an open position.

First Embodiment

Figure 1:
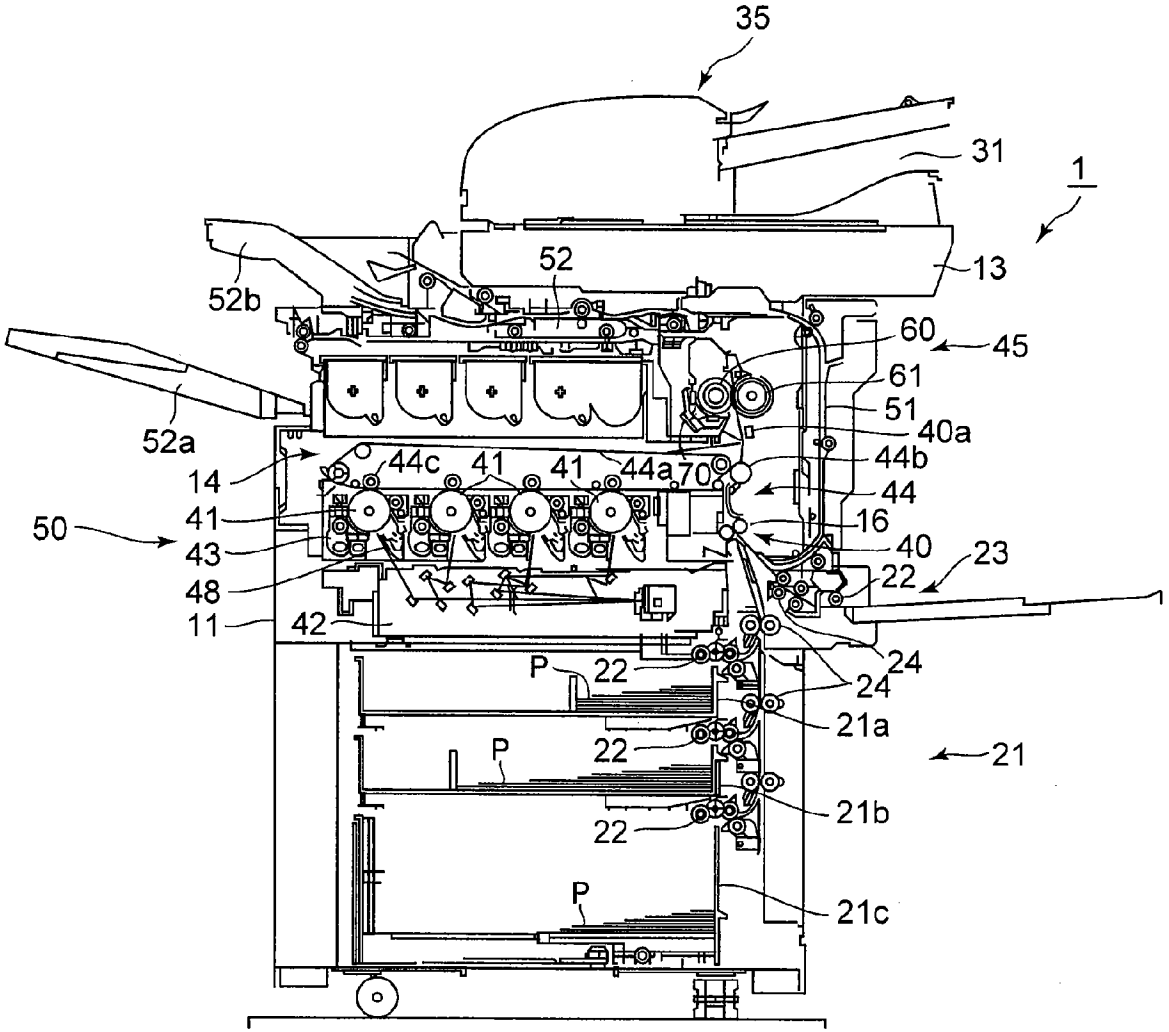
FIG. 1 is a schematic diagram of a MFP mounted with a fuser according to a first embodiment.

FIG. 1 is a schematic diagram of a multi functional peripheral (hereinafter referred to as MFP) 1 as an image forming apparatus mounted with a fuser according to a first embodiment. The MFP 1 includes a scanner unit 13 configured to read an image, a printer unit 14 as an image forming unit, a paper feeding unit 21 configured to feed sheets P as recording media, and a paper discharging unit 52 including a first tray 52*a* and a second tray 52*b* in which the sheets P discharged by the printer unit 14 are accumulated. The MFP 1 includes a manual paper feeding unit 23 on a side of a housing 11. The MFP 1 includes a conveying mechanism 40 for the sheets P halfway in a path reaching from the paper feeding unit 21 or the manual paper feeding unit 23 to the paper discharging unit 52 through the printer unit 14.

The scanner unit 13 scans an original document supplied by an auto document feeder (ADF) 35 and captures image information. After the completion of the capturing of the image information by the scanner unit 13, the ADF discharges the original document to a document discharging unit 31.

The printer unit 14 forms, on the sheet P, images corresponding to input image information or the captured image information from the scanner unit 13. The printer unit 14 includes four sets of image forming stations 50 for yellow (Y), magenta (M), cyan (C), and black (K), an exposing device 42, and a transfer unit 44 configured to transfer toner images formed by the image forming stations 50 onto the sheet P having an arbitrary size. The printer unit 14 includes a fuser 45 as a fuser configured to fix the toner images on the sheet P.

The four sets of image forming stations 50 have the same structure. Each of the image forming stations 50 includes a photoconductive drum 41, a charging device 48 configured to uniformly charge the photoconductive drum 41, and a developing device 43 configured to develop an electrostatic latent image formed on the photoconductive drum 41 by irradiation of exposure light of the exposing device 42 after the charging and form a toner image. The transfer unit 44 includes an intermediate transfer belt 44*a*, a primary transfer roller 44*c*, and a secondary transfer roller 44*b*.

The paper feeding unit 21 includes an upper paper feeding cassette 21*a*, a lower paper feeding cassette 21*b*, and a large capacity cassette 21*c*. The conveying mechanism 40 includes a conveying roller 24 configured to feed the sheet P extracted from the paper feeding unit 21 or the manual paper feeding unit 23 by a pickup roller 22 to the transfer unit 44. The conveying mechanism 40 also includes a registration roller 16. The conveying mechanism 40 conveys the sheet P having a fixed toner image to the paper discharging unit 52 or a circulating path 51 through the transfer unit 44 and the fuser 45. The paper discharging unit 52 discharges the sheet P to the first tray 52*a* or the second tray 52*b* or reverses the sheet P in the direction of the circulating path 51. The circulating path 51 leads the sheet P to the transfer unit 44 again. The conveying mechanism 40 includes a sheet sensor 40*a* configured to detect the sheet P while the sheet P reaches from the transfer unit 44 to the fuser 45.

The MFP 1 irradiates, according to the start of image formation, exposure light on the photoconductive drum 41 with the exposing device 42 after charging the photoconductive drum 41 with the charging device 48 and forms an electrostatic latent image corresponding to the exposure light on the photoconductive drum 41. The developing device 43 applies a toner to the electrostatic latent image on the photoconductive drum 41 to visualize the electrostatic latent image. The transfer unit 44 transfers a toner image obtained by visualizing the electrostatic latent image on the photoconductive drum 41 onto the sheet P via the intermediate transfer belt 44*a*.

The sheet P fed from the paper feeding unit 21 or the manual paper feeding unit 23 reaches, through the conveying mechanism 40, a nip between the intermediate transfer belt 44*a* and the secondary transfer roller 44*b* in synchronization with the toner image primarily transferred onto the intermediate transfer belt 44*a*. The secondary transfer roller 44*b* secondarily transfers the toner image on the intermediate transfer belt 44*a* onto the sheet P that passes through the nip between the intermediate transfer belt 94*a* and the secondary transfer roller 44*b*. The fuser 45 fixes the toner image on the sheet P. The paper discharging unit 52 discharges the sheet P having the toner image fixed thereon to the first tray 52*a* or the second tray 52*b*. The circulating path 51 leads the sheet P having the toner image fixed thereon in the direction of the secondary transfer roller 44*b* of the transfer unit 44 again.

Figure 2:
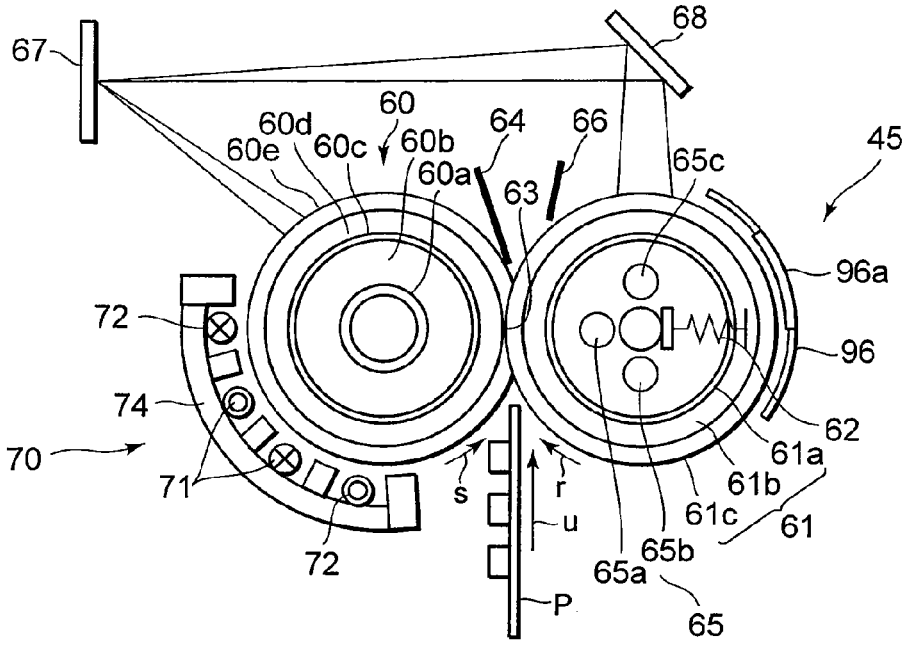
FIG. 2 is a schematic diagram of a fuser according to the first embodiment viewed from a side.

The fuser 45 is explained in detail below. FIG. 2 is a schematic diagram of the fuser 45 viewed from a side. The fuser 45 includes a heat roller 60 as a rotational member having a diameter of 30 mm, a press roller 61 as a press member having a diameter of 30 mm, and an electromagnetic induction coil (hereinafter abbreviated as IH coil) 70 as an induction-current generator. The heat roller 60 is formed by sequentially laminating, around, for example, a core bar 60*a*, a foamed rubber (sponge) layer 60*b* having thickness of 5 mm, a metal layer 60*c* of nickel (Ni) as a metal conducive layer having thickness of 40 μm, a solid rubber layer 60*d* made of silicon rubber having thickness of 200 μm, and a release layer 60*e* made of PFA tube. A material of the metal layer 60*c* may be stainless steel, aluminum (Al), a composite material of stainless steel and aluminum, or the like.

Figure 3A:
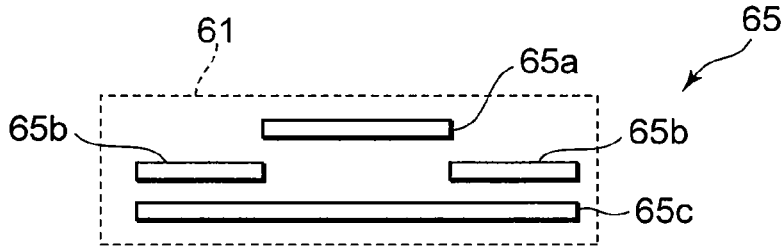
FIG. 3A is a schematic explanatory diagram of a heating area of an auxiliary lamp in the first embodiment.

The press roller 61 includes an auxiliary lamp 65 in, for example, a hollow core bar 61*a*. The auxiliary lamp 65 includes, for example, first to third halogen lamps 65*a*, 65*b*, and 65*c*. As shown in FIG. 3A, the first halogen lamp 65*a* heats a center area of the press roller 61. The second halogen lamps 65*b* heat both side areas of the press roller 61. The third halogen lamp 65*c* heats an entire length area of the press roller 61. Power consumption of the first halogen lamp 65*a* and the second halogen lamps 65*b* is 300 W respectively. Power consumption of the third halogen lamp 65*c* is 200 W.

The press roller 61 is formed by laminating a silicon sponge rubber layer 61*b* and a fluorine rubber layer 61*c* around the core bar 61*a*. A pressing mechanism 62 brings the press roller 61 into press contact with the heat roller 60 to form a fixing point 63 as a nip having fixed width between the heat roller 60 and the press roller 61. The press roller 61 rotates in an arrow r direction and the heat roller 60 rotates in an arrow s direction following the press roller 61. The press roller 61 and the heat roller 60 cause the sheet P to travel in an arrow u direction and pass through the fixing point 63 between the heat roller 60 and the press roller 61. The press roller 61 and the heat roller 60 melt and compression-bond the toner image on the sheet P to fix the toner image on the sheet P.

The fuser 45 includes, further on a downstream side in a rotating direction than the fixing point 63 on the circumference of the heat roller 60, a first separating blade 64 configured to separate the sheet P from the surface of the heat roller 60. The fuser 45 includes, further on a downstream side in a rotating direction than the fixing point 63 on the circumference of the press roller 61, a second separating blade 66 configured to separate the sheet P from the surface of the press roller 61.

The main body of the MFP 1 includes, on a side of the fuser 45 close to the heat roller 60, an infrared temperature sensor 67 of a non-contact thermopile type as a non-contact temperature detector configured to detect an infrared ray. The infrared temperature sensor 67 is, for example, a compound-eye type. One infrared temperature sensor 67 detects temperatures in plural places in time series.

Figure 3B:
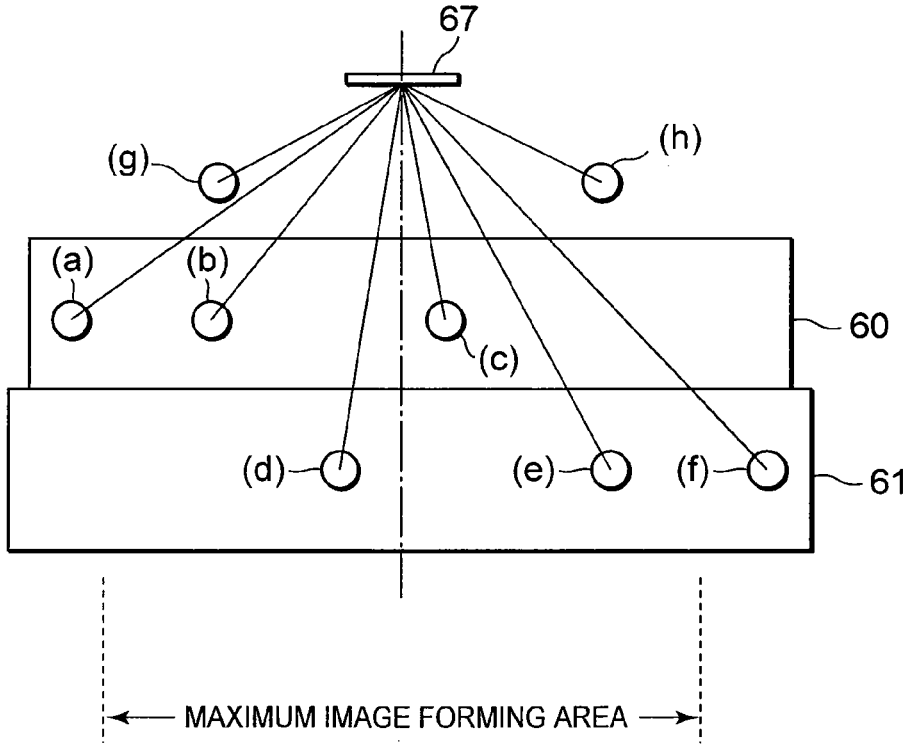
FIG. 3B is a schematic explanatory diagram of a temperature detection section of the fuser according to the first embodiment viewed from above of FIG. 2.

The infrared temperature sensor 67 performs, for example, temperature detection for places shown in FIG. 3B. The infrared temperature sensor 67 measures, on the heat roller 60 side, three places (a), (b), and (c) until the sheet P reaches the IH coil 70 after passing through the fixing point 63. The infrared temperature sensor 67 measures, on the press roller 61 side, three places (d), (e), and (f) on the surface in an upper position of the press roller 61 via an infrared reflection mirror 68. The place (a) of the heat roller 60 and the place (f) of the press roller 61 are located on the outer side of a maximum image formation area. The infrared reflection mirror 68 has a reflection surface applied with infrared reflection coating. Further, the infrared temperature sensor 67 measures two places (g) and (h) of an area in the fuser 45.

The infrared temperature sensor 67 measures the eight places in total. However, places measured by the infrared temperature sensor 67 are not limited to the eight places. When the number of measurement places increases, a sampling interval and measurement time of the infrared temperature sensor 67 are extended. Therefore, it is desirable to set measurement places according to print speed of the MFP 1 or circumferential speed of the heat roller 60 or the press roller 61.

Figure 4:
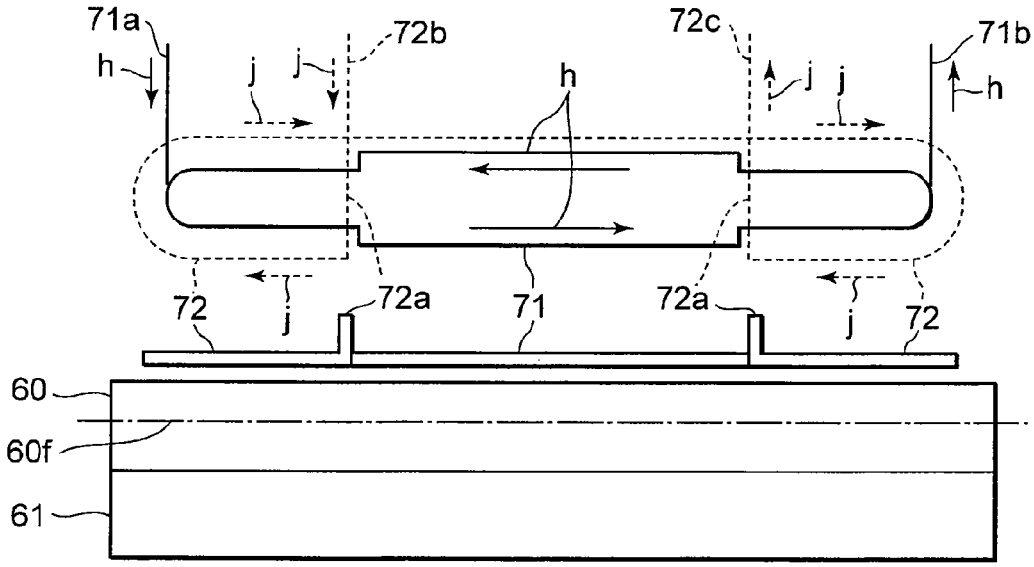
FIG. 4 is a schematic explanatory diagram of an IH coil in the first embodiment.

The IH coil 70 is present on the main body side of the MFP 1. In the IH coil 70, a first coil 71 and second coils 72 are wound around a magnetic core 74 to intensify a magnetic field. As shown in FIG. 4, the first coil 71 feeds electric current in an arrow h direction from a draw-out line 71*a* in the direction of a draw-out line 71*b* and excites the metal layer 60*c* over the entire length in the longitudinal direction of the heat roller 60. The second coils 72 feed, on both the sides of the heat roller 60, electric current in an arrow j direction from a draw-out line 72*b* in the direction of a draw-out line 72*c* and cancels the excitation of the metal layer 60*c* by the first coil 71. A flow of the electric currents of the two second coils 72 opposed to both the sides of the heat roller 60 is opposite to a flow of the electric current of the first coil 71. The two second coils 72 opposed to both the sides of the heat roller 60 are connected in series and driven by the same control.

As the first coil 71, for example, a Litz wire obtained by binding sixteen copper wire materials having a wire diameter of 0.5 mm coated with heat resistant polyamideimide as an insulating material is used. By using the Litz wire, it is possible to reduce the wire diameter to be smaller than depth of penetration and effectively feed AC current. A magnetic flux and eddy-current are generated in the metal layer 60*c* by applying high-frequency current to the first coil 71 and generating a magnetic flux. Jour heat is generated by the eddy-current and a resistance value of the metal layer 60*c* and heats the surface of the heat roller 60.

The second coils 72 have winding specifications same as those of the first coil 71. Inner ends 72*a* of the second coils 72 on both the sides of the heat roller 60 are laminated in the height direction. In the second coils 72, a magnetic flux is sharply generated by laminating the inner ends 72*a*.

When the first coil 71 is exited, the heat roller 60 can, heat a sheet having width of, for example, JIS standard "A4" portrait size (297 mm). When the first coil 71 is excited and high-frequency current is applied to the second coils 72 to cancel the excitation by the first coil 71, the heat roller 60 can heat a sheet having width of, for example, JIS standard "A4" landscape size (210 mm).

The draw-out wires 71*a* and 71*b* of the first coil 71 and the draw-out wires 72*b* and 72*c* of the second coils 72 are drawn out in a direction orthogonal to an axis direction 60*f* of the heat roller 60. The draw-out wires 71*a*, 71*b*, 72*b*, and 72*c* are drawn out in the direction orthogonal to the axis direction 60*a* of the heat roller 60, whereby the number of windings of the first coil 71 and the number of windings of the second coils 72 in the longitudinal direction of the rotating heat roller 60 are equalized. When the draw-out wires 71*a*, 71*b*, 72*b*, and 72*c* are drawn out in the direction orthogonal to the axis direction 60*a* of the heat roller 60 and a driving circuit is arranged in the drawing-out direction, it is possible to reduce the length of the draw-out wires, suppress the influence of the draw-out wires on the IH coil 70, and realize formation of the first coil, the second coils, and the driving circuit as a unit.

The first coil 71 receives the input of electric current from the draw-out wire 71*a* and outputs the electric current from the draw-out wire 71*b*. The second coils 72 receive the input of electric current from the draw-out wire 72*b* and output the electric current from the draw-out wire 72*c*. As shown in FIG. 4, at both the ends of the heat roller 60, the current direction of the first coil 71 and the current direction of the second coils 72 are opposite. The electric currents cancel excitation each other.

Figure 5:
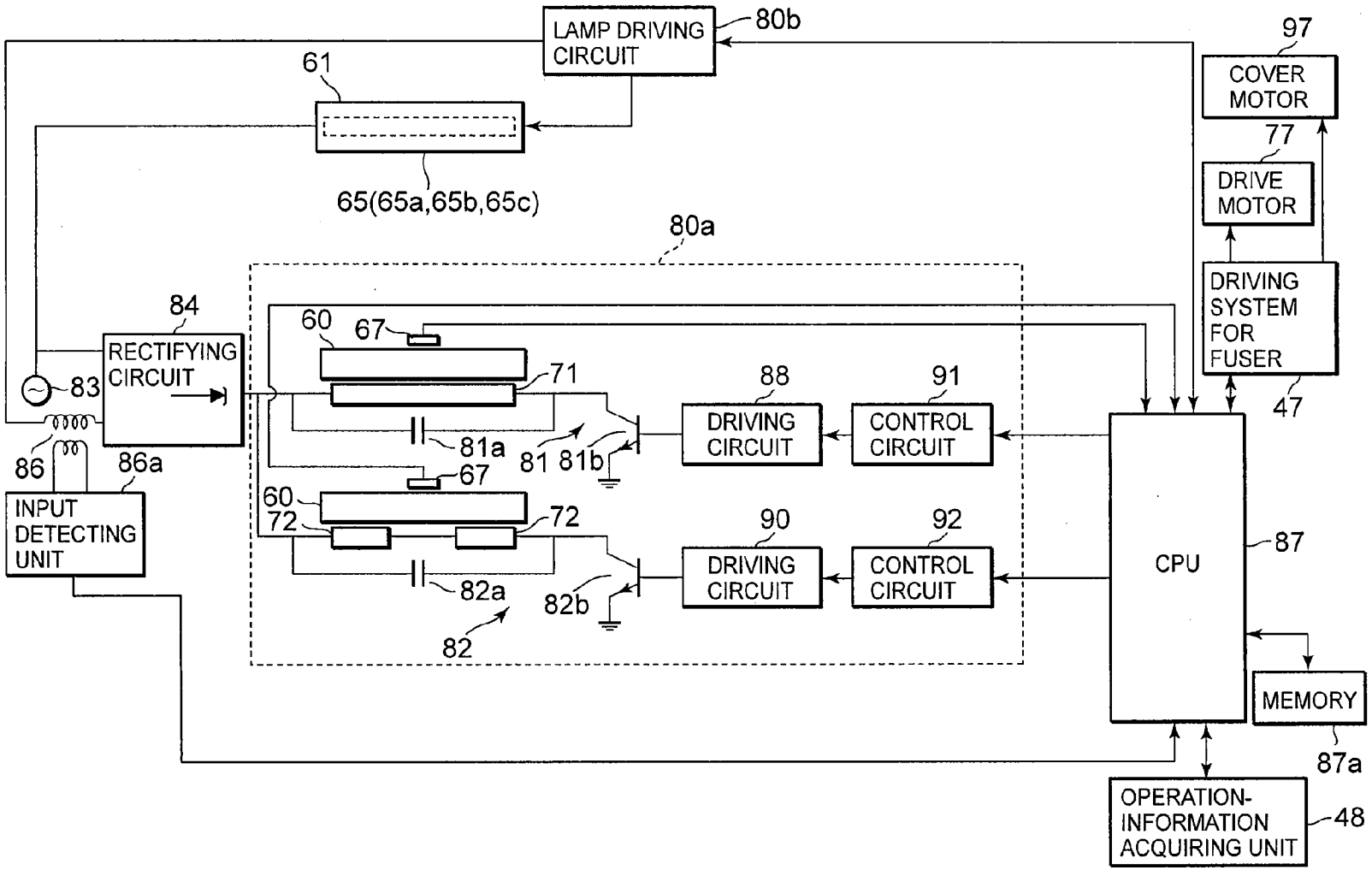
FIG. 5 is a schematic block diagram of a control system for the IH coil in the first embodiment.

A block diagram of a control system 80 for the fuser 45 is shown in FIG. 5. The control system 80 includes a coil driving circuit 80*a* configured to control the IH coil 70 and a lamp driving circuit 80*b* configured to control ON and OFF of the first to third halogen lamps 65*a*, 65*b*, and 65*c*.

The control system 80 includes a CPU 87 as a controller configured to control the coil driving circuit 80*a* and the lamp driving circuit 80*b* according to a detection result of the infrared temperature sensor 67. The CPU 87 controls the entire MFP 1 and controls a driving system 47 for the fuser 45. The driving system 47 controls to drive, for example, a drive motor 77 configured to drive the press roller 61 and a cover motor 97 configured to move a heat insulation cover 96 explained later. The CPU 87 executes various computer programs stored in a memory 87*a* and performs temperature control for controlling the coil driving circuit 80*a* and the lamp driving circuit 80*b* and driving control for the driving system 47. The CPU 87 is connected to an operation-information acquiring unit 48 configured to acquire information concerning an operation state such as a warm-up mode, a ready mode, or a paper passing mode of the MFP 1.

The coil driving circuit 80*a* includes a first inverter circuit 81 configured to supply high-frequency current to the first coil 71, a second inverter circuit 82 configured to supply high-frequency current to the second coils 72, and a rectifying circuit 84 configured to supply DC current obtained by smoothing a commercial AC power supply 83 to the first inverter circuit 81 and the second inverter circuit 82. The first inverter circuit 81 includes a first capacitor 81*a* for resonance connected in parallel to the first coil 71 and a first switching element 81*b*. The second inverter circuit 82 includes a second capacitor 82*a* for resonance connected in parallel to the second coils 72 and a second switching element 82*b*.

As the first switching element 81*b* or the second switching element 82*b*, for example, an IGBT (Insulated Gate Bipolar Transistor) that can be used at high withstanding voltage and large current is used. A MOS-FET or the like may be used as the first switching element 81*b* or the second switching element 82*b*. The control system includes a transformer 86 at a pre-stage of the rectifying circuit 84 and detects all power consumptions via an input detecting unit 86*a*.

First and second driving circuits 88 and 90 are respectively connected to control terminals of the first and second switching elements 81*h* and 82*b*. The CPU 87 controls first and second control circuits 91 and 92. The first and second control circuits 91 and 92 respectively control ON times of the first and second driving circuits 88 and 90. The first and second control circuits 91 and 92 respectively control the ON times of the first and second driving circuits 88 and 90 to thereby vary the high-frequency current fed to the first coil 71 and the high-frequency current fed to the second coils 72 in a range of a frequency of, for example, 20 kHz to 100 kHz. The first and second control circuits 91 and 92 vary the frequency in the range of 20 kHz to 100 kHz and change power supply to the first coil 71 or the second coils 72 in a range of 200 W to 1000 W. The CPU 87 sends, according to a detection result of the infrared temperature sensor 67, for example, a command for instructing to which value the power supply to the first coil 71 or the second coils 72 is set to the first or second control circuit 91 or 92.

The IH coil 70 may include, according to various sheet sizes, for example, plural coils for demagnetization for canceling the excitation of the first coil 71.

Figure 6:
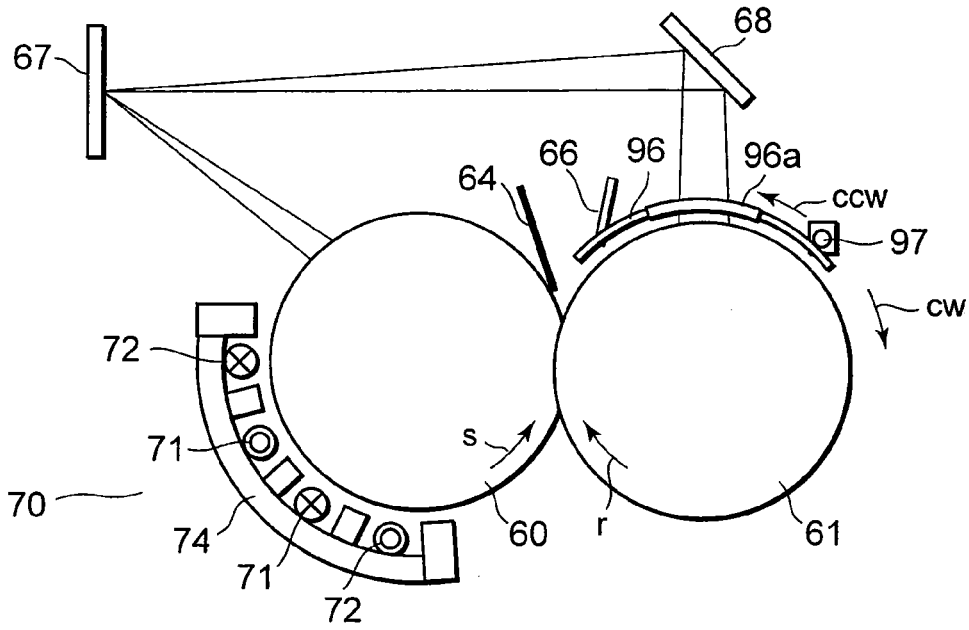
FIG. 6 is a schematic diagram of a state in which a heat insulation cover in the first embodiment is moved to a closed position.

The fuser 45 includes the heat insulation cover 96 as a heat insulating member configured to move around the press roller 61. The heat insulation cover 96 is present on the main body side of the MFP 1. The heat insulation cover 96 is formed of, for example, heat resistant resin. The main body of the MFP 1 includes the cover motor 97 configured to rotationally move the heat insulation cover 96 around the axis of the press roller 61. While the fuser 45 performs fixing operation, the heat insulation cover 96 is located in a position shown in FIG. 2 where the heat insulation cover 96 does not prevent the conveyance of the sheet P. While the fuser 45 performs non-fixing operation, the heat insulation cover 96 moves to a closed position shown in FIG. 6 and covers the surface of the press roller 61 further in a downstream position than the fixing point 63 with respect to a conveying direction of the sheet P. When the fuser 45 completes the fixing operation, the cover motor 97 rotationally moves the heat insulation cover 96 in an arrow ccw direction around the axis of the press roller 61. While the fuser 45 is in a non-fixing mode, the heat insulation cover 96 moves to the closed position to thereby effectively thermally insulate the press roller 61.

The heat insulation cover 96 has a window 96*a* not to prevent surface temperature detection for the press roller 61 by the infrared temperature sensor 67 when the heat insulation cover 96 is located in the closed position. The window 96*a* is formed of a heat resistant member, which transmits an infrared ray, such as a heat resistant glass coated with infrared transmission coating on the surface thereof. While the heat insulation cover 96 is located in the closed position, the CPU 87 performs temperature control in the non-fixing mode in a state in which the press roller 61 is thermally insulated.

The CPU 87 controls, in a state in which the heat insulation cover 96 is closed, electric power supplied to the first coil 71 and the second coils 72 according to temperature detection in the heat roller 60, the press roller 61, and the fuser 45 by the infrared temperature sensor 67. The fuser 45 maintains, in a state in which the heat insulation cover 96 is closed, the warm-up mode, the ready mode, a preheat mode, a sleep mode, or the like. The heat insulation cover 96 has a slit for preventing interference with the second separating blade 66 when the heat insulation cover 96 moves to the closed position.

The fuser 45 is in, for example, the ready mode, the preheat mode, or the sleep mode after warm-up. When printing is started, the CPU 87 performs temperature control for the heat roller 60 and the press roller 61 according to a detection result of the infrared temperature sensor 67. After returning the heat roller 60 and the press roller 61 to the ready mode, the CPU 87 feedback-controls the lamp driving circuit 80*b* and the first and second inverter circuits 81 and 82 according to a detection result of the infrared temperature sensor 67 and maintains the heat roller 60 and the press roller 61 at fixing temperature. At the same time, the CPU 87 controls the driving system 47 for the fuser to drive to rotate the heat roller 60 and the press roller 61 and rotationally moves the heat insulation cover 96 in an arrow cw direction with the cover motor 97 to uncover the fixing point 63.

The fuser 45 fixes, while the sheet P having a toner image passes through the fixing point 63, the toner image on the sheet P. The fuser 45 separates the leading end of the sheet P from the heat roller 60 and the press roller 61 with the first separating blade 64 and the second separating blade 66 and conveys the sheet P in the direction of the paper discharging unit 52. When fixing for sheets by a number included in a job including the started printing is completed, the CPU 87 controls to drive the cover motor 97, rotates the heat insulation cover 96 in an arrow ccw direction, and moves the heat insulation cover 96 to the closed position. At the same time, the CPU 87 shifts to temperature control in the non-fixing mode in a state in which the press roller 61 is thermally insulated.

According to the first embodiment, during non-fixing, in a state in which the press roller 61 is covered with the heat insulation cover 96 and the fuser 45 is efficiently thermally insulated, temperature control in the non-fixing mode during warm-up, during ready, during preheating, or the like can be performed and power consumption can be saved. Return time from the preheat mode or the sleep mode can be reduced. Since the window 96*a* is provided in the heat insulation cover 96, temperature detection by the infrared temperature sensor 67 can be performed even if the heat insulation cover 96 is closed.

Since the infrared temperature sensor 67, the IH coil 70, and the heat insulation cover 96 are arranged on the MFP 1 side, connection of electric power and a signal between the fuser 45 and the main body of the MFP 1 is unnecessary. A harness for connecting electric power and a signal can be omitted. Therefore, a reduction in size and cost of the fuser 45 can be realized.

Second Embodiment

A second embodiment is explained below. In the second embodiment, the IH coil 70 in the first embodiment is moved to the closed position. In the second embodiment, components same as those explained in the first embodiment are denoted by the same reference numerals and signs and detailed explanation of the components is omitted.

Figure 7:
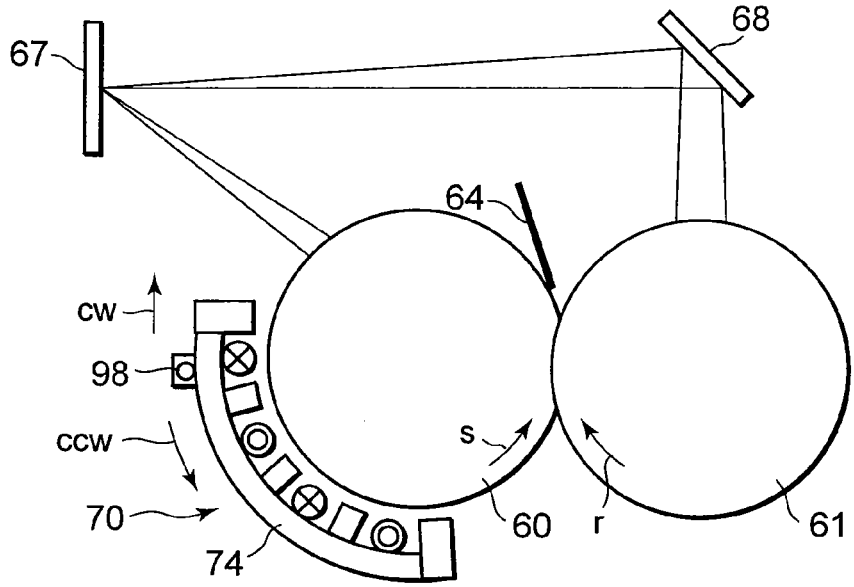
FIG. 7 is a schematic diagram of a state in which an IH coil in a second embodiment is located in an open position.

In the second embodiment, the main body of the MFP 1 includes a coil motor 98 configured to rotationally move the IH coil 70 around the axis of the heat roller 60. While the fuser 45 is in the warm-up mode, the ready mode, or the paper passing mode, the IH coil 70 is located in an open position shown in FIG. 7. When the fuser 45 changes to a low-power mode of the preheat mode and further of the sleep mode, the IH coil 70 moves to a closed position shown in FIG. 8A.

Opening and closing operation for the IH coil 70 and the heat insulation cover 96 is explained below. FIG. 8B is a flowchart for explaining opening and closing operation for the IH coil 70 and the heat insulation cover 96. During power-on, the IH coil 70 is initialized to the open position and the heat insulation cover 96 is initialized to the closed position (ACT 200). The CPU 87 performs warm-up control in a state in which the heat insulation cover 96 is closed (ACT 201). The CPU 87 controls, according to a temperature detection result of the infrared temperature sensor 67, electric power supplied to the first coil 71 and the second coils 72 and controls ON and OFF of the first to third halogen lamps 65*a*, 65*b*, and 65*c* respectively.

The fuser 45 is set ready (ACT 202) and the MFP 1 starts printing (Yes in ACT 203). During fixing of the fuser 45, the CPU 87 performs open operation for the heat insulation cover 96 (ACT 204). The CPU 87 drives the cover motor 97 to rotate the heat insulation cover 96 in the arrow cw direction and move the heat insulation cover 96 to the open position. The MFP 1 prints sheets by a number included in a job including the started printing (ACT 205). When the fuser 45 changes to non-fixing, the CPU 87 performs closing operation for the heat insulation cover 96 (ACT 206). The CPU 87 drives the cover motor 97 to rotate the heat insulation cover 96 in the arrow ccw direction and move the heat insulation cover 96 to the closed position shown in FIG. 6.

The fuser 45 repeats ACT 203 to ACT 206 in the ready mode. After the fuser 45 changes to the ready mode or the MFP 1 completes the printing, when the fuser 45 changes to the low-power mode such as the preheat mode or the sleep mode (ACT 207), the CPU 87 performs closing operation for the IH coil 70 (ACT 208).

Figure 8A:
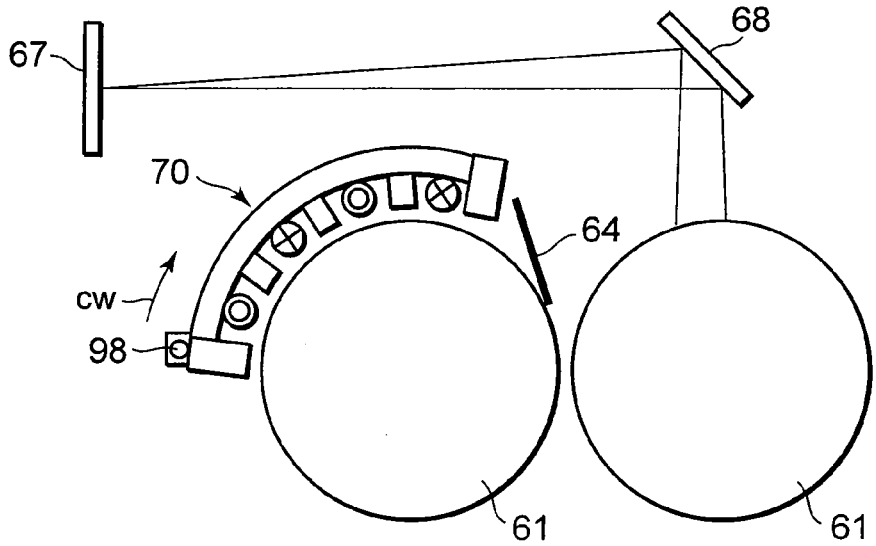
FIG. 8A is a schematic diagram of a state in which the IH coil in the second embodiment is moved to a closed position.
Figure 8B:
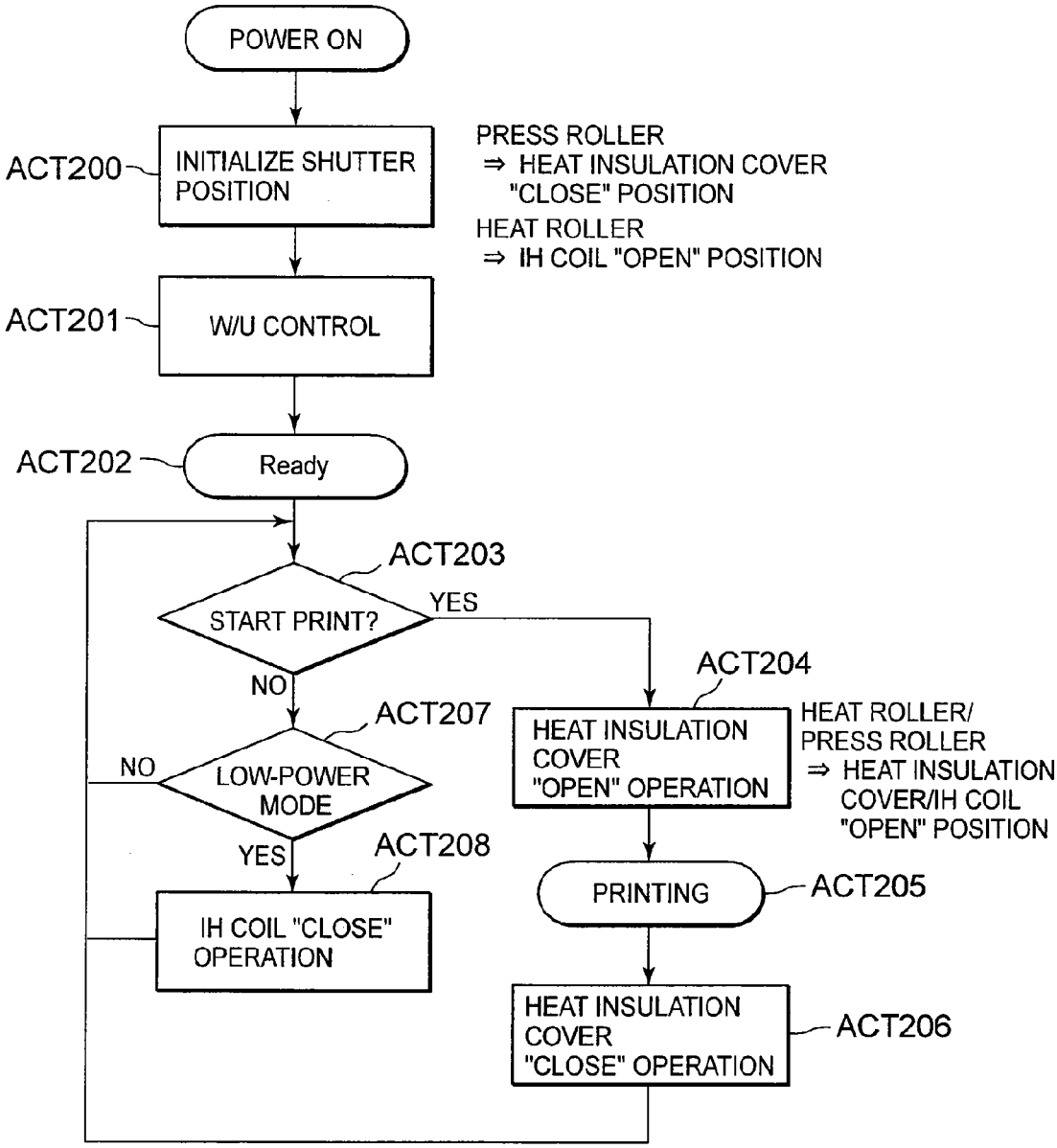
FIG. 8B is a flowchart for explaining opening and closing operation for the IH coil and a heat insulation cover in the second embodiment.

The CPU 87 drives the coil motor 98 to rotate the IH coil 70 in the arrow cw direction around the axis of the heat roller 60 and move the IH coil 70 to the closed position shown in FIG. 8A. The IH coil 70 covers the upper surface of the heat roller 60 in a further downstream position than the fixing point 63 with respect to the conveying direction of the sheet P. The CPU 87 performs temperature control in the low-power mode in a state in which the heat roller 60 is thermally insulated by the IH coil 70.

While the fuser 45 is in the low-power mode, the IH coil 70 moves to the closed position to thereby effectively thermally insulate the heat roller 60. While the IH coil 70 is located in the close position, the IH coil 70 closes a detection path of the infrared temperature sensor 67. While the IH coil 70 is located in the closed position, power application to the IH coil 70 cannot be performed for prevention of malfunction.

During the temperature control in the low-power mode, the axis of the press roller 61 moves away from the axis of the heat roller 60 while keeping the contact between the press roller 61 and the heat roller 60. For example, in the preheat mode, the CPU 87 feeds back a detection result of the temperature of the press roller 61 by the infrared temperature sensor 67 to the lamp driving circuit 80*b* and maintains the press roller 61 at preheating temperature lower than fixable temperature. In the sleep mode, the CPU 87 controls to shut off the lamp driving circuit 80*b* and does not perform power supply to the auxiliary lamp 65. When printing is instructed during the sleep mode, the CPU 87 immediately feedback-controls the coil driving circuit 80*a* and the lamp driving circuit 80*b*, supplies electric power to the IH coil 70 or the auxiliary lamp 65, and changes the heat roller 60 to the ready state.

According to the second embodiment, during non-fixing, the press roller 61 is covered with the heat insulation cover 96 and, in the low-power mode, the heat roller 60 is covered with the IH coil 70. Temperature control can be performed in a state in which the fuser 45 is efficiently thermally insulated. Power consumption can be saved.

Third Embodiment

A third embodiment is explained below. In the third embodiment, during non-fixing, the first separating blade 64 in the first embodiment is moved to a separated position. In the third embodiment, components same as those explained in the first embodiment are denoted by the same reference numerals and signs and detailed explanation of the components is omitted.

Figure 9:
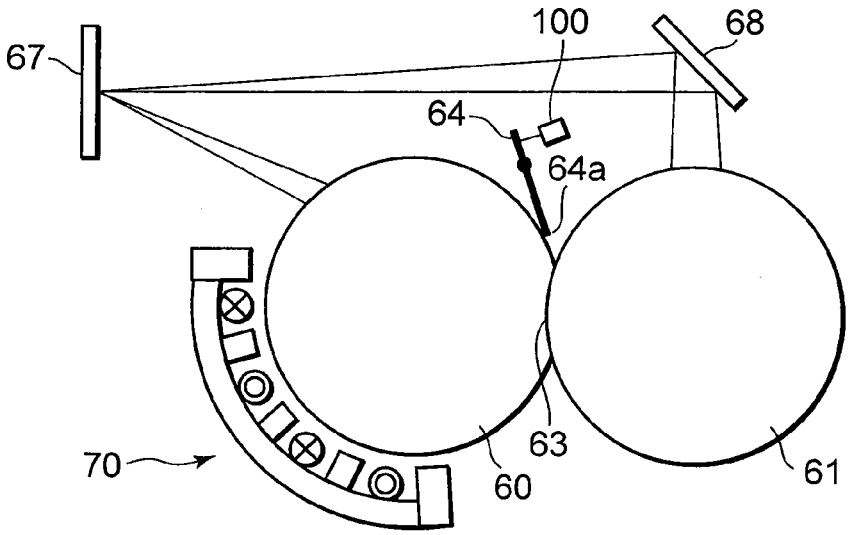
FIG. 9 is a schematic diagram of a state in which a first separating blade in a third embodiment is located in a closed position.
Figure 10:
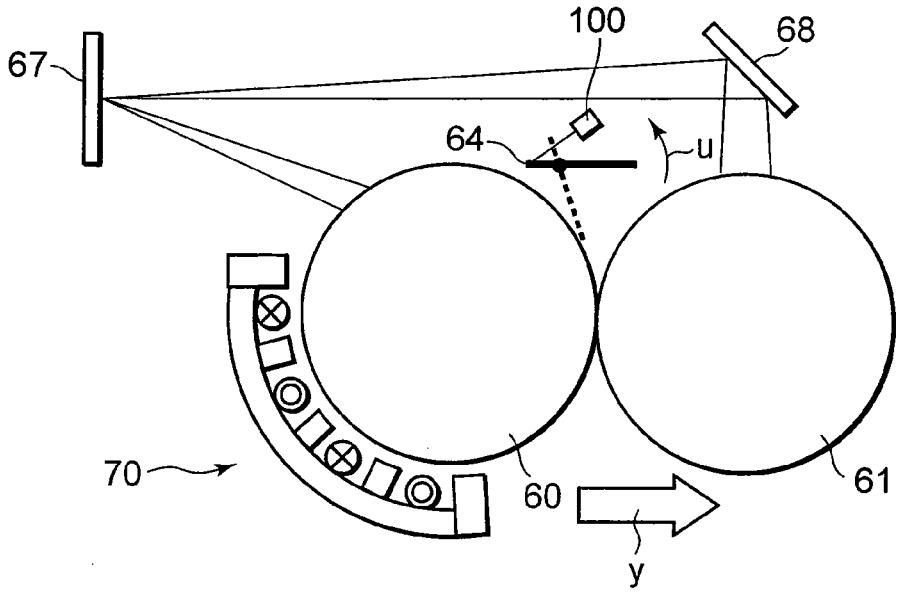
FIG. 10 is a schematic diagram of a state in which the first separating blade in the third embodiment is moved to an open position.

In the third embodiment, the MFP 1 includes, on the main body side, a solenoid 100 configured to open and close the first separating blade 64. During fixing, the solenoid 100 is turned on. As shown in FIG. 9, a distal end 64*a* of the first separating blade 64 is located in a closed position and maintains a gap of, for example, 0.3 mm between the distal end 64*a* and the heat roller 60. During non-fixing, the solenoid 100 is turned off. As shown in FIG. 10, the first separating blade 64 rotates in an arrow u direction and moves to an open position. The first separating blade 64 covers the fixing point 63.

Since the first separating blade 64 is moved to be opened and closed, during fixing, the distal end 64*a* of the first separating blade 64 maintains a very small gap between the distal end 64*a* and the surface of the heat roller 60. During fixing, the first separating blade 64 surely separates the leading end of the sheet P from the heat roller 60. During non-fixing, the first separating blade 64 substantially separates the distal end 64*a* of the first separating blade 64 from the heat roller 60. The distal end 64*a* of the first separating blade 64 is prevented from coming into contact with the heat roller 60 to damage the surface of the heat roller 60. The fixing point 63 is covered with the first separating blade 64 to improve a heat insulation effect of the heat roller 60.

The inside of the heat roller 60 is the foamed rubber layer 60*b*. The gap between the heat roller 60 and the distal end 64*a* of the first separating blade 64 changes according to a contact state with the press roller 61 or a heating state. During fixing shown in FIG. 9, the press roller 61 comes into press contact with the heat roller 60, whereby the surface of the heat roller 60 at the fixing point 63 is deformed into a concave shape. During non-fixing shown in FIG. 10, the press roller 61 moves in an arrow y direction and the pressing on the heat roller 60 is released. The surface of the heat roller 60 at the fixing point 63 is expanded by the release of the pressing by the press roller 61.

In the third embodiment, as in the first embodiment, power consumption can be saved by covering the press roller 61 with the heat insulation cover 96 during non-fixing. Further, the distal end 64*a* of the first separating blade 64 is surely prevented from coming into contact with the surface of the heat roller 60 when the surface of the heat roller 60 at the fixing point 63 is expanded.

Fourth Embodiment

A fourth embodiment is explained below. In the fourth embodiment, stable rotation control for the heat roller 60 in the first embodiment is obtained. In the fourth embodiment, components same as those explained in the first embodiment are denoted by the same reference numerals and signs and detailed explanation of the components is omitted.

In the fourth embodiment, the heat roller 60 includes the foamed rubber layer 60*b* in the inside, the press roller 61 includes the silicon sponge rubber layer 61*b*, and both the heat roller 60 and the press roller 61 are elastic members. Therefore, even if shaft rotating speed of the heat roller 60 is measured, it is difficult to accurately control rotating speed of the heat roller 60. In the fourth embodiment, fluctuation in surface temperature of the heat roller 60 is measured to accurately control the rotating speed of the heat roller 60.

Figure 11:
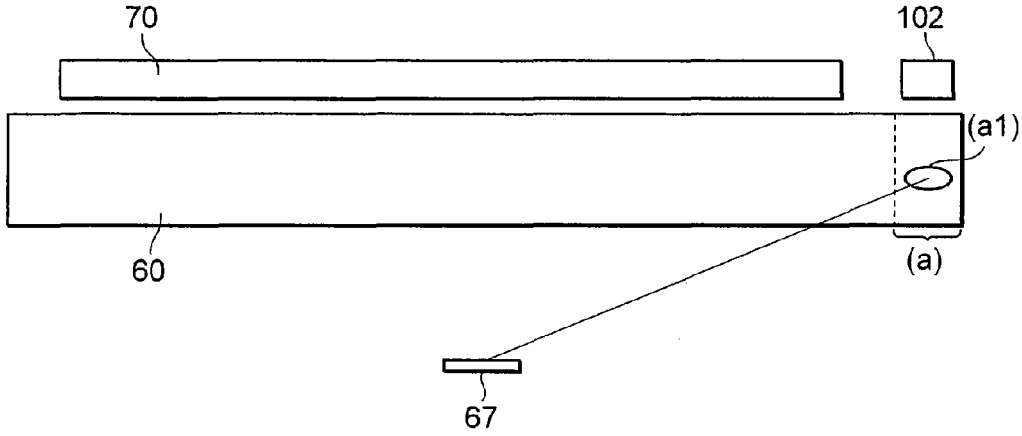
FIG. 11 is a schematic explanatory diagram of the arrangement of a heating element in a fourth embodiment viewed from a plane.
Figure 12:
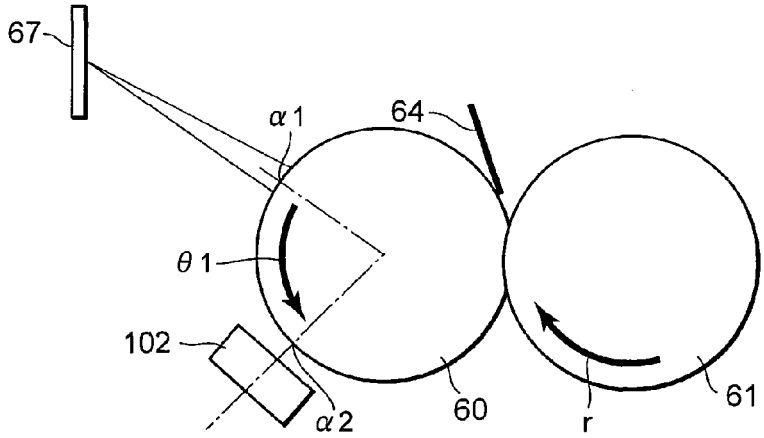
FIG. 12 is a schematic explanatory diagram of the arrangement of the heating element in the fourth embodiment viewed from a side.

In the fourth embodiment, as shown in FIGS. 11 and 12, a heating element 102 for rotating speed control for the heat roller 60 is provided to be opposed to a measurement place (a) of the heat roller 60 by the infrared temperature sensor 67 shown in FIG. 3D that is a non-image forming section at a side end of the heat roller 60. As shown in FIG. 12, a heating position α2 by the heating element 102 around the heat roller 60 shifts from a detection position α1 of the infrared temperature sensor 67 by an angle (θ1). As the heating element 102, a local heating source such as a ceramic heater or a thermal head configured to generate a temperature pattern on the surface of the heat roller 60 is used.

Figure 13:
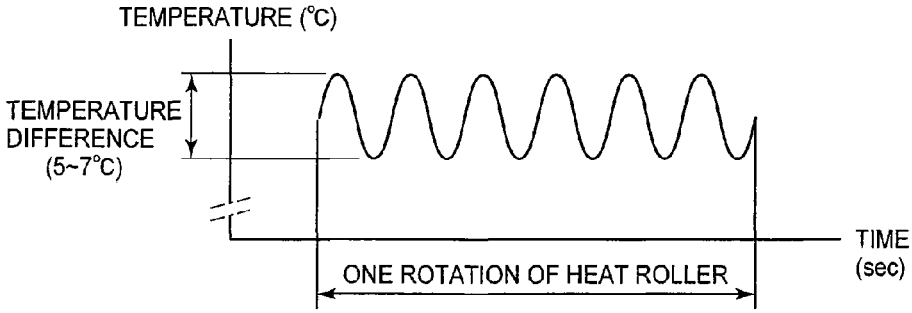
FIG. 13 is a graph of a sine pattern on the surface of a heat roller in the fourth embodiment.

During rotation of the heat roller 60, the heating element 102 heats a local place (a1) at the side end of the heat roller 60. The infrared temperature sensor 67 detects the temperature of the measurement place (a) at the end of the heat roller 60 at a fixed frequency. The CPU 87 measures a period of a temperature pattern on the surface of the heat roller 60 according to a detection result of the infrared temperature sensor 67. The CPU 87 feedback-controls the drive motor 77 using the measured period of the temperature pattern. The temperature pattern on the surface of the heat roller 60 indicates a sine pattern as shown in FIG. 13. The CPU 87 determines circumferential speed of the heat roller 60 according to the number of sine patterns in one rotation of the heat roller 60. When the number of sine patterns in one rotation of the heat roller 60 reaches a predetermined number, the CPU 87 determines that the circumferential speed of the heat roller 60 reaches fixed speed.

The heating element 102 heats the local place (a1) such that the amplitude of the sine pattern is, for example, equal to or larger than 5° C. During initial time until the rotation of the heat roller 60 is stabilized, it is more desirable to raise heating temperature of the local place (a1) such that the amplitude of the sine pattern is equal to or larger than 7° C. The heating element 102 does not need to heat the heat roller 60 in every rotation of the heat roller 60. When the amplitude of the sine pattern is equal to or smaller than 5° C., the heating element 102 heats the local place (a1) with phases of heating places aligned. To align the phases, since a detection position by the infrared temperature sensor 67 on the surface of the heat roller 60 and an opposed position of the heating element 102 with respect to the heat roller 60 shift by the angle (θ1), when a temperature difference equal to or smaller than 5° C. is detected, after the infrared temperature sensor 67 detects a peak value, the heating element 102 is driven at a delay of time equivalent to the angle (θ1).

A frequency of the sine pattern by the heating element 102 is finer than a measurement period of the infrared temperature sensor 67. For example, when set circumferential speed of the heat roller 60 is V [mm/s] and circumferential length of the heat roller 60 is L [mm], the period of the temperature pattern of the heating element 102 is nV/L (n=1, 2 . . . ). When the measurement period of the infrared temperature sensor 67 is represented as f[Hz], the measurement period is set to satisfy a relation f>nV/L. Further, to more accurately obtain rotation speed control for the heat roller 60, it is desirable to set n to be equal to or larger than 5 (n≧5). In the fourth embodiment, actually, the measurement period of the infrared temperature sensor 67 was evaluated under conditions of ranges f=500 [Hz], n=5 to 10, V=200 [mm/s], and L=30π [mm] and satisfactory rotation speed control of the heat roller 60 was obtained.

According to the fourth embodiment, as in the first embodiment, power consumption can be saved by covering the press roller 61 with the heat insulation cover 96 during non-fixing. Further, in order to control the rotating speed of the heat roller 60, the local place (a1) of the heat roller 60 is heated by the heating element 102 and the measurement place (a) is detected by the infrared temperature sensor 67 to obtain a sine pattern. It is possible to surely detect the circumferential speed of the surface of the heat roller 60 as an elastic member, perform rotation control for the heat roller 60, and obtain satisfactory fixing performance.

Fifth Embodiment

A fifth embodiment is explained below. In the fifth embodiment, separating performance for the leading end of the sheet P from the heat roller 60 in the first embodiment is improved. In the fifth embodiment, components same as those explained in the first embodiment are denoted by the same reference numerals and signs and detailed explanation of the components is omitted.

In the fifth embodiment, as shown in FIGS. 14 and 15, when the sheet P passes through the fixing point 63, the nip width of the fixing point 63 is controlled according to the position of the sheet P. During normal fixing, when the press roller 61 comes into press contact with the heat roller 60, the nip width of the fixing point 63 changes to, for example, 6 mm.

When the sheet sensor 40*a* detects the leading end of the sheet P, in synchronization with the leading end of the sheet reaching the fixing point 63, the CPU 87 controls the pressing mechanism 62 to weaken applied pressure of the press roller 61 applied to the heat roller 60. The CPU 87 reduces, for example, the nip width of the fixing point 63 by about 30% compared with the nip width during fixing and weakens the applied pressure of the press roller 61 such that, for example, the nip width is reduced to about 4 mm. The CPU 87 weakens the applied pressure of the press roller 61 to prevent pressure from being excessively applied to a toner image at the leading end of the sheet P (over pressure) and prevent the toner image from bonding the leading end of the sheet P to the heat roller 60.

Subsequently, the sheet sensor 40*a* detects that the sheet P passes, for example, 10 mm from the leading end. After the sheet P reaches the fixing point 63, when the sheet sensor 40*a* detects that the sheet P passes 10 mm, the CPU 87 returns the pressing mechanism 62 to normal applied pressure and returns the nip width of the fixing point 63 to width of 6 mm during normal fixing.

Timing for returning the pressing mechanism 62 to the normal applied pressure is not limited. When both separating performance for the leading end of the sheet P from the heat roller 60 and maintenance of fixing performance are taken into account, it is desirable to return the pressing mechanism 62 to the normal applied pressure in a range of passage of 5 mm to 15 mm after the sheet P reaches the fixing point 63.

Actually, a sheet having weight of 64 grams per 1 $m^2$ was used, the nip width of the fixing point 63 was changed, and evaluation of separating performance was tested. A test result is shown in FIG. 16. In FIG. 16, A represents satisfactory separating performance, B represents unstable separating performance, and C represents difficulty in separating.

When the nip width of the fixing point 63 is equal to or smaller than 5 mm, the leading end of the sheet P is satisfactorily separated from the heat roller 60. When the nip width of the fixing point 63 is in a range of 5.5 mm to 6 mm, the separating performance for the leading end of the sheet P is unstable. When the nip width of the fixing point 63 is equal to or larger than 6.5 mm, separating is difficult.

Since the nip width of the fixing point 63 is small at the leading end of the sheet P, fixing time is reduced. However, when the leading end of the sheet P reaches the fixing point 63, an area adjacent to a non-paper passing area of the heat roller 60 already reaches the fixing point 63 and the surface temperature of the heat roller 60 is high. Therefore, regardless of the fact that the fixing time is reduced, the fixing performance for the leading end of the sheet P does not fall. However, after the passage of the leading end of the sheet P, in order to compensate for a temperature fall that occurs because the temperature of the heat roller 60 is deprived by the sheet P, the CPU 87 returns the nip width of the fixing point 63 and returns the fixing time to the normal time to maintain the fixing performance.

According to the fifth embodiment, as in the first embodiment, power consumption can be saved by covering the press roller 61 with the heat insulation cover 96 during non-fixing. Further, during the passage of the leading end of the sheet P, the nip width of the fixing point 63 is reduced. After the passage of the leading end of the sheet P, the nip width of the fixing point 63 is returned to the nip width during the normal fixing. The leading end of the sheet P is prevented from adhering to the heat roller 60 during fixing to improve separating performance for a sheet while maintaining fixing performance.

Sixth Embodiment

A sixth embodiment is explained below. In the sixth embodiment, separating performance in separating the leading end of the sheet P from the heat roller 60 in the fifth embodiment is further improved. In the sixth embodiment, components same as those explained in the fifth embodiment are denoted by the same reference numerals and signs and detailed explanation of the components is omitted.

Figure 17:
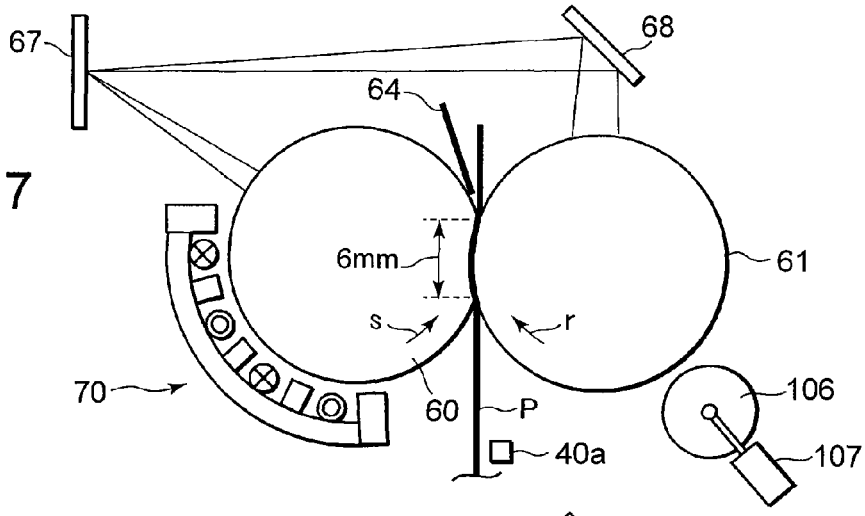
FIG. 17 is a schematic explanatory diagram of a state during normal fixing in a sixth embodiment.
Figure 18:
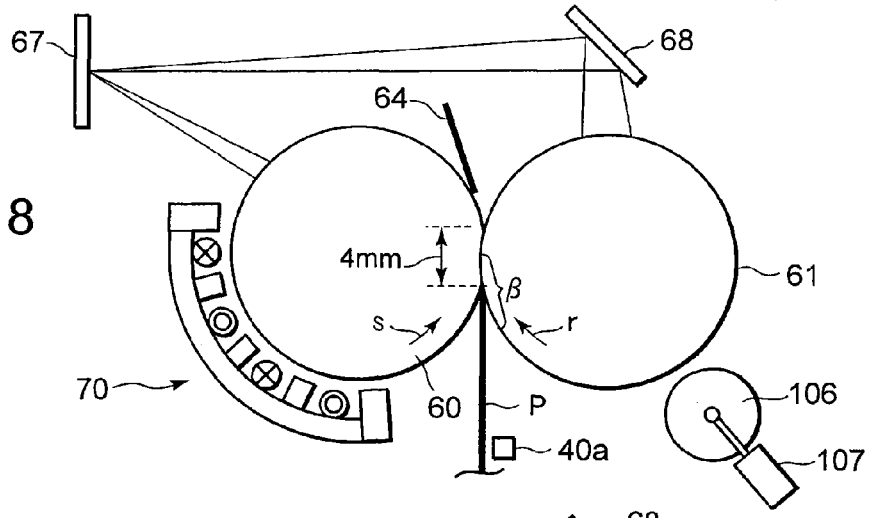
FIG. 18 is a schematic explanatory diagram of a state during fixing on a sheet leading end in the sixth embodiment.
Figure 19:
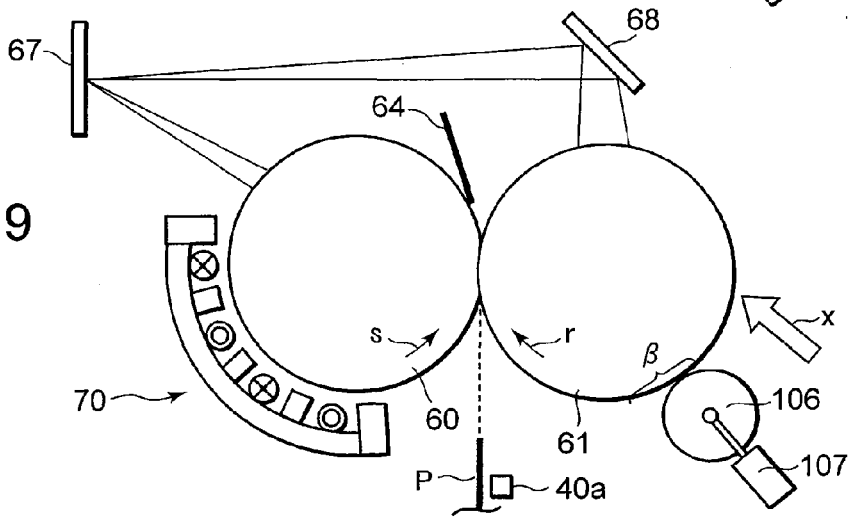
FIG. 19 is a schematic explanatory diagram of contact of a temperature control roller with respect to a separating area in the sixth embodiment.

In the sixth embodiment, as shown in FIGS. 17 to 19, a fuser includes a temperature control roller 106 capable of coming into contact with the press roller 61 and a contact and separation mechanism 107 configured to bring the temperature control roller 106 into contact with the press roller 61 or separate the temperature control roller 106 from the press roller 61. The temperature control roller 106 is formed of, for example, aluminum (Al) having high heat radiation properties. As the contact and separation mechanism 107, for example, a solenoid is used. The temperature control roller 106 comes into contact with the press roller 61 and lowers the temperature of the surface of the press roller 61 in a contact position. Usually, the temperature control roller 106 is located in a position separated from the press roller 61.

During normal fixing, the press roller 61 sets the nip width of the fixing point 63 to 6 mm and sets the nip width of the fixing point 63 during the passage of the leading end of the sheet P to 4 mm. The temperature control roller 106 comes into contact with a separating area β of the surface of the press roller 61 that reaches the fixing point 63 in synchronization with the leading end of the sheet P.

The CPU 87 controls the contact and separation mechanism 107 according to detection of the leading end of the sheet P by the sheet sensor 40*a* to slide the temperature control roller 106 in an arrow x direction and bring the temperature control roller 106 into contact with the separating area β of the press roller 61 in advance. After the separating area β of the press roller 61 passes, the contact and separation mechanism 107 slides the temperature control roller 106 in a direction opposite to the arrow x direction and separates the temperature control roller 106 from the press roller 61. According to the contact with the temperature control roller 106, the temperature of the separating area β of the press roller 61 falls below the temperature during normal fixing.

When the leading end of the sheet P passes the fixing point 63, the applied pressure of the press roller 61 is weakened and, at the same time, the leading end of the sheet P is pressed in the separating area β of the press roller 61 where the temperature is low. A toner image at the leading end of the sheet P is prevented from being excessively heated (over heat). The toner image is prevented from bonding the leading end of the sheet P to the heat roller 60.

The temperature of the separating area β of the press roller 61 that reaches the fixing point 63 in synchronization with the leading end of the sheet P reaching the fixing point 63 is lower than the surface temperature of the press roller 61 during normal fixing. However, when the leading end of the sheet P reaches the fixing point 63, an area adjacent to a non-paper passing area of the heat roller 60 already reaches the fixing point 63 and the surface temperature of the heat roller 60 is high. Therefore, regardless of the fact that the fixing time is reduced and the surface temperature of the press roller 61 falls, the fixing performance for the leading end of the sheet P does not fall.

Figures 20, 21:
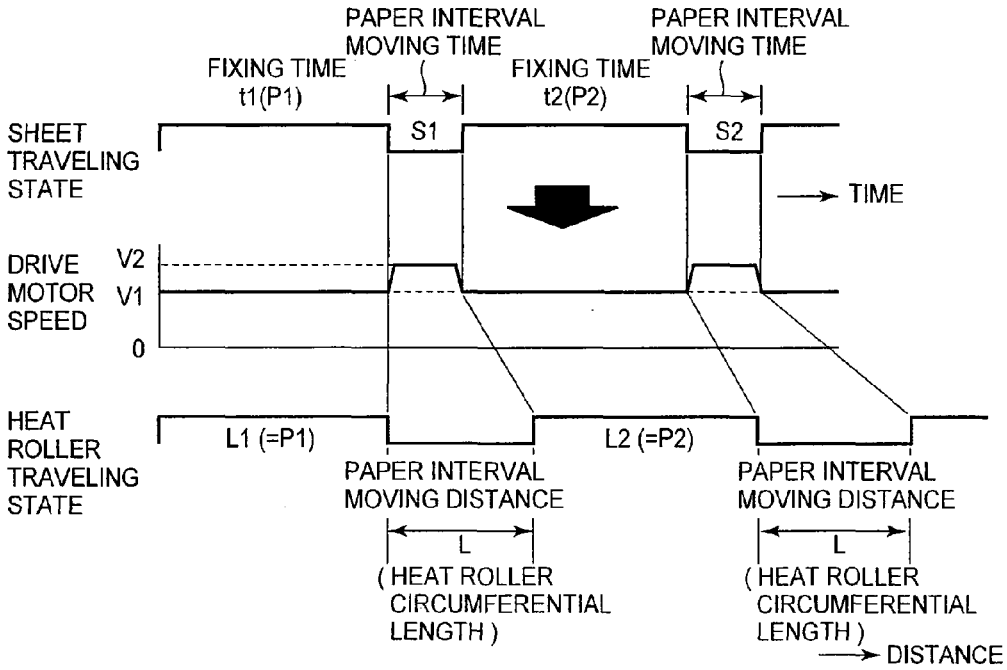
FIG. 20 is a graph of separating performance for a sheet and fixing performance with respect to the temperature of the separating area in the sixth embodiment.
FIG. 21 a timing chart of heat roller speed and a traveling state of the heat roller with respect to a traveling state of a sheet in a seventh embodiment.

Actually, the nip width of the fixing point 63 was set to 4 mm, the separating area β of the press roller 61 was set to 2 mm or 3 mm, the surface temperature of the separating area β was changed with respect to the surface temperature of the heat roller 60, and evaluation of separating performance was tested. A test result is shown in FIG. 20. A represents that satisfactory separating is obtained at margin of 2 mm at the leading end, B represents that satisfactory separating is obtained at a margin of 3 mm at the leading end, and C represents that separating is difficult even at a margin of 3 mm at the leading end. Halftone dot meshing portions represent areas where fixing performance falls and a toner image is offset.

It is seen from FIG. 20 that, for example, at the temperature of the heat roller 60 is 110° C., when the separating area β is set to 2 mm and the surface temperature of the press roller 61 is set to 100° C. to 110° C., although satisfactory separating performance is obtained, fixing performance falls because of low-temperature offset. Under the same condition except that the temperature of the separating area β is set to 120° C. to 130° C., both separating performance and fixing performance are satisfactory. When the separating area β is set to 3 mm and the temperature of the separating area β is set to 140° C. to 160° C., both separating performance and fixing performance are satisfactory.

Further, it is seen from FIG. 20 that, for example, at the temperature of the heat roller 60 is 170° C., when the separating area β is set to 2 mm and the surface temperature of the press roller 61 is set to 100° C., both separating performance and fixing performance are satisfactory. When the separating area β is set to 3 mm and the temperature of the separating area β is set to 110° C. to 130° C., both separating performance and fixing performance are satisfactory. When the separating area β is set to 3 mm and the temperature of the separating area β is set to 140° C., satisfactory separating performance is obtained. However, fixing performance falls because of high-temperature offset. When the separating area β is set to 3 mm and the temperature of the separating area β is set to 150° C. to 160° C., it is difficult to separate the leading end of the sheet P and fixing performance also falls because of high-temperature offset.

For example, setting of an amount of change of the nip width during the passage of the leading end of the sheet P or an amount of temperature change of the press roller 61 is changed according to the thickness of the sheet.

According to the sixth embodiment, as in the fifth embodiment, during the passage of the leading end of the sheet P, the nip width of the fixing point 63 is reduced. After the passage of the leading end of the sheet P, the nip width of the fixing point 63 is returned to the nip width during the normal fixing. Further, on the press roller 61 side, the temperature control roller 106 is brought into contact, in advance, with the separating area β where the leading end of the sheet P is pressed to lower the temperature of the separating area β. The leading end of the sheet P is prevented from adhering to the heat roller 60 during fixing to improve separating performance for a sheet while maintaining fixing performance.

Seventh Embodiment

A seventh embodiment is explained below. In the seventh embodiment, gloss unevenness that occurs on one sheet because of a temperature step of the heat roller 60 in the first embodiment is reduced. In the seventh embodiment, components same as those in the first embodiment are denoted by the same reference numerals and signs and detailed explanation of the components is omitted.

In general, since a heat capacity of the metal layer 60*c* of the heat roller 60 is small, a heat quantity of the heat roller 60 is deprived by the passage of the sheet P during fixing and a temperature fall of the heat roller 60 becomes conspicuous. On the other hand, a temperature fall of the heat roller 60 does not occur at a paper interval between sheets. Therefore, a temperature step occurs in a sheet P passing area and a paper interval area. When an area where a temperature step of the heat roller 60 occurs passes through the fixing point 63 during fixing on one sheet P, the temperature step appears in a fixed image as gloss unevenness. Gloss unevenness of an image conspicuously appears in a color image having high fixing temperature or thick paper having a large heat quantity necessary for fixing and causes an image failure. In the seventh embodiment, the driving of the heat roller 60 is controlled in order to eliminate the temperature step on the surface of the heat roller 60.

When a paper interval of a preceding sheet P1 and a following sheet P2 is set to be one rotation of the heat roller 60 during fixing of the heat roller 60, a temperature step due to the paper interval does not occur on the heat roller 60.

However, when the paper interval is set wide to be equivalent to one rotation of the heat roller 60, the paper interval is long and it is likely that high-speed properties of the fuser 45 are spoiled. In the seventh embodiment, the high-speed properties of the fuser 45 are not spoiled and the temperature step on the heat roller 60 is reduced.

In the seventh embodiment, as shown in FIG. 21, the CPU 87 controls, during printing, the drive motor 77 at, for example, normal fixing speed V1 during time t1 in which an image is fixed on the preceding sheet P1. The heat roller 60 travels a distance L1 (=P1) during fixing time t1 in synchronization with the sheet P1. During moving time S1 at the paper interval after the trailing end of the preceding sheet P1 passes through the fixing point 63 until the leading end of the following sheet P2 reaches the fixing point 63, the CPU 87 accelerates the drive motor 77 from the fixing speed V1 to paper interval speed V2. The CPU 87 detects, with the sheet sensor 40*a*, the trailing end of the preceding sheet P1 and the leading end of the following sheet P2 and detects the moving time S1 at the paper interval.

The paper interval speed V2 is speed that satisfies a condition V2×S1=L, (the circumferential length of the heat roller 60). Specifically, the CPU 87 sets the speed of the drive motor 77 to the paper interval speed V2 to thereby rotate the heat roller 60 once during the moving time S1 at the paper interval. The surface temperature of the heat roller 60 is substantially equal over the entire length of one rotation without causing a temperature step.

In general, when electric power applied to the IH coil 70 is set the same, if time is the same, a heat quantity generated in the metal layer 60*c* is the same. Therefore, when the traveling speed of the heat roller 60 is increased, the temperature of the heat roller 60 can be reduced compared with the temperature during low-speed traveling. When the traveling speed of the heat roller 60 is increased to V2 during the moving time S1 at the paper interval, a marked temperature rise in the heat roller 60 that occurs even in non-paper passage compared with during paper passage can also be eliminated.

After the moving time S1 at the paper interval elapses (after the heat roller 60 is rotated once in a state of non-paper passage), the CPU 87 returns the control of the drive motor 77 to the normal fixing speed V1 in synchronization with the following sheet P2 reaching the fixing point 63.

During the moving time S1 at the paper interval, when the drive motor 77 is accelerated from the fixing speed V1 to the paper interval speed V2, at the same time, the electric power applied to the IH coil 70 may be changed. When the CPU 87 accelerates the drive motor 77 to the paper interval speed V2, at the same time, the CPU 87 may control the electric power applied to the IH coil 70 to be low compared with electric power during fixing (during paper passage) and control a heat generation of the metal layer 60*c* of the heat roller 60 during non-paper passage to be low.

According to the seventh embodiment, as in the first embodiment, power consumption can be saved by covering the press roller 61 with the heat insulation cover 96 during non-fixing. Further, during the moving time S1 at the paper interval, the heat roller 60 is accelerated to the paper interval speed V2 to rotate the heat roller 60 once. Regardless of the fact that the paper interval is set to one rotation of the heat roller 60, high-speed properties of the fuser can be maintained. The temperature step on the surface of the heat roller 60 due to the paper interval is reduced and gloss unevenness is prevented from appearing on one sheet P to improve image quality.

Eighth Embodiment

An eighth embodiment is explained below. In the eighth embodiment, gloss unevenness that occurs on a sheet when a fixing belt is used instead of the heat roller 60 in the first embodiment is reduced. In the eighth embodiment, components same as those explained in the first embodiment are denoted by the same reference numerals and signs and detailed explanation of the component is omitted.

Figure 22:
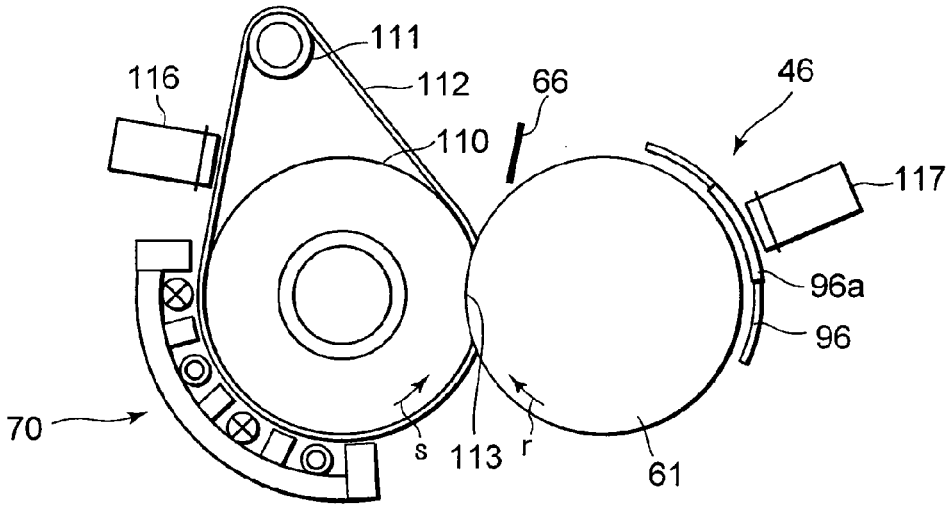
FIG. 22 is a schematic diagram of a fuser according to an eighth embodiment.

In the eighth embodiment, as shown in FIG. 22, a fuser includes a fixing belt 112 laid over a backup roller 110 having an outer diameter of 48.5 mm and a satellite roller 111 having an outer diameter of 17 mm. The fixing belt 112 forms a fixing point 113 having fixed width between the fixing belt 112 and the press roller 61. The main body of the MFP 1 includes a belt sensor 116 on a side close to the fixing belt 112 of a fuser 46 and includes a roller sensor 117 on a side close to the press roller 61.

Both of the belt sensor 116 and the roller sensor 117 include compound-eye type infrared temperature sensors of a non-contact thermopile type. The belt sensor 116 measures plural places on the fixing belt 112 and predetermined places in the fuser 46, for example, after passing through the fixing point 113, until the fixing belt 112 reaches the IH coil 70. The roller sensor 117 measures plural places of the press roller 61. When the heat insulation cover 96 is located in the open position, the roller sensor 117 measures the temperature of the press roller 61 via the window 96*a*.

The backup roller 110 is formed by coating, by thickness of 9.25 mm, a porous silicon sponge layer having a very small and uniform cell diameter over the outer circumference of a core bar having, for example, thickness of 3 mm, an outer diameter of 30 mm. The core bar is formed of iron taking into account a magnetic circuit matching with the IH coil 70. The porous silicon sponge layer having a very small and uniform cell diameter is a material having a characteristic that, when heated and pressed for a long period, hardness thereof gradually increases. The cell diameter is, for example, equal to or smaller than 50 μm. A body section of the backup roller 110 that supports the fixing belt 112 has a heat capacity of 45 [J/K]

The satellite roller 111 is formed by, for example, a pipe made of aluminum having thickness of 2 mm. A shaft end of the satellite roller 111 has a shaft section of iron or SUS. A body section of the satellite roller 111 that supports the fixing belt 112 has a heat capacity of 15 [J/K]. In the satellite roller 111, a heat pipe may be included in the pipe made of aluminum.

The fixing belt 112 is formed by sequentially laminating, on a metal layer of, for example, nickel (Ni) having thickness of 40 μm, a bonding layer having thickness of 20 μm, a silicon rubber layer having thickness of 200 μm, and a release layer of fluorine resin having thickness of 30 μm. The fixing belt 112 has length of 183 mm. The fixing belt 112 is stretched between the backup roller 110 and the satellite roller 111 at fixed tension. The fixing belt 112 is supported by the satellite roller 111 having a heat capacity of 15 [J/K], whereby the fixing belt 112 has an apparent heat capacity.

Originally, the fixing belt 112 has an extremely small heat capacity. Since the fixing belt 112 has an extremely small heat capacity, the fixing belt 112 has an advantage that the fixing belt 112 can reduce warm-up time for the fuser 46 and contribute to saving of energy. On the other hand, since the fixing belt 112 has an extremely small heat capacity, a temperature fall due to passage of a sheet is marked. Since the temperature fall due to passage of a sheet is marked, when an image is fixed on a sheet having a size longer than the circumferential length of the fixing belt 112, a fixing temperature difference at a period of the circumferential length of the fixing belt 112 occurs on the sheet. When the fixing temperature difference is large, it is likely that gloss unevenness occurs in a fixed image on the sheet.

For example, for a test, when fixing on a sheet having a size longer than the circumferential length of a belt (B), which supports the fixing belt 112 only with the backup roller 110, is performed by using the belt (B), heat of the belt (B) is deprived by the sheet and the temperature of the belt (B) falls. After passing the fixing point 113, the belt (B) is heated by the IH coil 70. However, in the case of a sheet such as thick paper having a large heat capacity, even if the belt (B) is heated by the IH coil 70 after fixing, the temperature of the belt (B) cannot return to temperature at the beginning of the start of fixing. Actually, even in the case of plain paper, when basis weight of the plain sheet is the maximum (e.g., 105 g paper), the belt (B) cannot return to the temperature at the beginning of the start of fixing even by heating by the IH coil 70. Since the temperature of the belt (B) does not return, a fixing temperature difference occurs between a fixing area by the belt (B) in the first rotation and an area by the belt (B) in the second rotation on one sheet. When the fixing temperature difference is marked, gloss unevenness occurs in a fixed image.

Conversely, at a paper interval between a preceding sheet and a following sheet, since the temperature of the belt (B) does not fall during passage through the fixing point 113, a temperature rise locally occurs in the belt (B) because of the next heating by the IH coil 70. When a fixing temperature difference is marked on one sheet between a fixing area by the belt (B) where the local temperature rise occurs and a fixing area where the temperature rise does not occur, gloss unevenness occurs in a fixed image.

Figure 23:
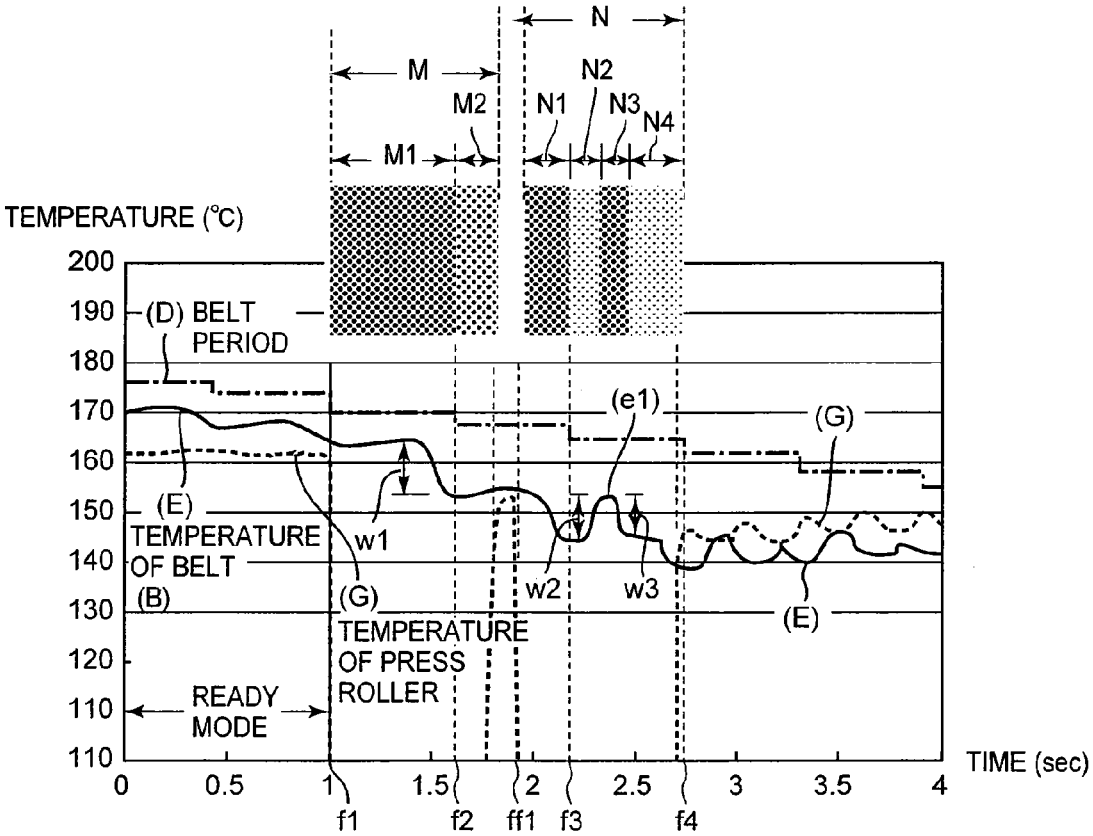
FIG. 23 is a graph for explaining an example of gloss unevenness due to a small heat capacity of a belt (B) in the eighth embodiment.

An example of a paper passing state, a temperature difference that occurs in the belt (B), and gloss unevenness on a sheet during fixing by the belt (B) having a small heat capacity is shown in FIG. 23. In FIG. 23, an alternate long and short dashes line (D) indicates a period of the belt (B), a solid line (E) indicates the temperature of the belt (B), and a dotted line (G) indicates the temperature of the press roller 61. In the ready mode, for example, when the first sheet M reaches the fixing point 113 at f1 and fixing is started, the belt (B) maintains temperature equal to or higher than 160° C. in a period of f1 to f2 when the belt (B) rotates once. After passing through the fixing point 113, the belt (B) is heated by the IH coil 70. However, in a period of f2 to f3 in the second rotation of the belt (B), the temperature of the belt (B) falls and does not reach 155° C.

Since the temperature of the belt (B) falls in the period of f2 to f3 in the second rotation of the belt (B), on the first sheet M, gloss unevenness occurs in an area (M1) that comes into contact with the belt (B) in the first rotation and an area (M2) that comes into contact with the belt (B) in the second rotation.

The gloss unevenness is caused when, since a heat capacity of the belt (B) is small, a supplied heat quantity does to catch up with a heat quantity consumed when an image is fixed on a sheet longer than the circumferential length of the belt (B). In particular, the gloss unevenness is conspicuous in water-resistant paper (e.g., eco-crystal paper manufactured by Tomoegawa Co., Ltd and Careca paper manufactured by Mitsubishi Kagaku Media Co., Ltd.). For example, fixing performance on the eco-crystal paper manufactured by Tomoegawa Co., Ltd. having length of 1200 mm was tested by using the belt (B). A test result is shown in FIG. 24. In FIG. 24, A indicates that separating evaluation is high, B indicates that separating evaluation is slightly low, and C indicates that separating evaluation is low. An index called fixing ratio used for normal fixing performance evaluation is equal to or higher than 85% over the entire length (120 mm) of the eco-crystal paper. This is a satisfactory level. However, in separating evaluation for an image scratched by a nail or the like, when the number of times of rotation of the belt (B) reaches six times, separating gradually occurs. In an area where the number of times of rotation of the belt (B) is seven times, an image failure due to separating of the image occurs because of in sufficiency of a heat quantity during fixing.

On the other hand, in an area (e1) of the belt (B) corresponding to a paper interval Q between a first sheet M and a second sheet N, a temperature rise is locally caused by the next heating by the IH coil 70. When fixing on the second sheet N is started at ff1, the sheet N comes into contact with the belt (B) having temperature that changes to a region of about 153° C. between f2 and f3 in the second rotation, a region where the temperature rises to about 153° C. in the area (e1), and a region where the temperature falls to be equal to or lower than 145° C. between f3 and f4 in the third rotation.

Since the second sheet N comes into contact with the belt (B) having the changing temperature, gloss unevenness occurs in an area (N1) where the sheet N comes into contact with the belt (B) in the second rotation, areas (N2 and N4) where the sheet N comes into contact with the belt (B) having the fallen temperature in the third rotation, and an area (N3) where the sheet N comes into contact with the belt (B) having the risen temperature at the paper interval. In general, when a fixing temperature difference of, for example, about 5° C. to 7° C. occurs while an image is fixed on one sheet, it is likely that the human eyes determine that gloss unevenness occurs.

In the eighth embodiment, an apparent heat capacity of the fixing belt 112 is increased by using the satellite roller 111 and a fixing temperature difference that occurs in the fixing belt 112 is absorbed to reduce gloss unevenness.

In the eighth embodiment, as shown in FIG. 22, the satellite roller 111 having a heat capacity of 15 [J/k] is brought into contact with the fixing belt 112, which finishes passing through the fixing point 113 and is yet to reach the IH coil 70, to even a temperature step of the fixing belt 112 caused by the passage through the fixing point 113. Gloss unevenness of the sheets M and N can be reduced by evening a particularly large temperature step in w1 (a temperature step in the first rotation and the second rotation of the belt (B)) or w2 and w3 (temperature steps in a paper passing area and a paper interval area of the belt (B)) shown in FIG. 23.

In the eighth embodiment, a distance is provided until the fixing belt 112 reaches the fixing point 113 after the satellite roller 111 is brought into contact with the fixing belt 112 to even the temperature step of the fixing belt 112. This makes it possible to facilitate temperature diffusion in the metal layer of the fixing belt 112. The temperature step of the fixing belt 112 can be further absorbed.

For example, in the case of a long sheet having length plural number of times as large as the circumferential length of the fixing belt 112, it is known in advance that fixing performance falls in the latter half of the sheet. Therefore, in order to supplement the fixing performance of the fixing belt 112, the satellite roller 111 is provided. Further, gloss unevenness may be more effectively eliminated by controlling to switch power supply to the IH coil 70 and the auxiliary lamp 65 in relation to the rotation of the fixing belt 112.

Total electric power that can be supplied to the fuser 46 is set to, for example, 1400 W. As shown in FIG. 25, before the power switching, the CPU 87 sets power supply to the IH coil 70 to 1100 W on the fixing belt 112 side and alternately turning on the 300 W first halogen lamp 65*a* and second halogen lamps 65*b* on the press roller 61 side to feedback-control the fixing belt 112 and the press roller 61. After the power switching, the CPU 87 sets the power supply to the IH coil 70 to 1200 W and supplies electric power to the 200 W third halogen lamp 65*c* on the press roller 61 side to feedback-control the fixing belt 112 and the press roller 61.

During fixing on a long sheet, since the sheet is discharged without using a finisher or the like, there is a margin in electric power of the entire MFP 1. Therefore, it is also possible to perform power switching for increasing the power supply to the IH coil 70 without reducing power supply to the auxiliary lamp 65. However, in this embodiment, when the power supply to the IH coil 70 is increased, electric power is switched to reduce the power supply to the auxiliary lamp 65 to improve fixing performance for the Long sheet without changing the total power of the MFP 1.

In the fuser 46 according to this embodiment, the power switching shown in FIG. 25 was carried out, fixing performance for the eco-crystal paper manufactured by Tomoegawa Co., Ltd. having length of 1200 mm was tested, and a result shown in FIG. 26 was obtained. In the test, during the start of fixing, the power supply to the IH coil 70 was set to 1100 W and the power supply to the auxiliary lamp 65 was set to 300 W. In the fourth rotation of the belt 112, the power supply to the IH coil 70 was switched to 1200 W and the power supply to the auxiliary lamp 65 was switched to 200 W. A indicates that separating evaluation is satisfactory. In this embodiment, a fixing ratio equal to or higher than 90% was obtained and excellent separating performance was obtained without occurrence of separating of an image over the entire length (120 mm) of the eco-crystal paper.

According to the eighth embodiment, as in the first embodiment, power consumption can be saved by covering the press roller 61 with the heat insulation cover 96 during non-fixing. Further, gloss unevenness of an image can be reduced by increasing an apparent heat capacity of the fixing belt 112, warm-up time for which is reduced to save power consumption.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. A fuser comprising:

a rotational member configured to rotate;

a press member configured to press the rotational member, the press member having an axis that is disposed in a common horizontal plane as an axis of the rotational member;

an induction-current generator configured to generate induction current in the rotational member;

a separator provided on an upper side of the axis of the rotational member and the axis of the press member, configured to separate from the rotational member a leading end of a recording medium that passes through a nip between the rotational member and the press member when a distal end of the separator is in a separating position, and configured to cover an upper side of the nip when the distal end of the separator is moved to an open position; and a heat insulator including a window that allows transmission of an infrared ray, the heat insulator being moveable around the press member.

2. The fuser according to claim 1, wherein the heat insulator includes a slit through which a second separator provided around the press member extends through when the heat insulator moves to a closed position.

3. An image forming apparatus comprising:

an image forming unit configured to form an image on a recording medium; and a fuser including: a rotational member configured to rotate; a press member configured to press the rotational member, the press member having an axis that is disposed in a common horizontal plane as an axis of the rotational member;

an induction-current generator configured to generate induction current in the rotational member;

a separator provided on an upper side of the axis of the rotational member and the axis of the press member, configured to separate from the rotational member a leading end of a recording medium that passes through a nip between the rotational member and the press member when a distal end of the separator is in a separating position, and configured to cover an upper side of the nip when the distal end of the separator is moved to an open position; and a heat insulator including a window that allows transmission of an infrared ray, the heat insulator being movable around the press member.

4. The image forming apparatus according to claim 3, wherein the heat insulator includes a slit through which a second separator provided around the press member extends through when the heat insulator moves to a closed position.

* * * * *